US007131849B2

(12) United States Patent
Nishimura et al.

(10) Patent No.: US 7,131,849 B2
(45) Date of Patent: Nov. 7, 2006

(54) CONNECTOR FOR CONNECTING PRINTED CIRCUIT BOARDS

(75) Inventors: Takeshi Nishimura, Santa Clara, CA (US); Toshiyasu Ito, Chiba-Ken (JP); Kiyoshi Abe, Cupertino, CA (US)

(73) Assignee: Yamaichi Electronics U.S.A., Inc., San Jose, CA (US)

( * ) Notice: Subject to any disclaimer, the term of this patent is extended or adjusted under 35 U.S.C. 154(b) by 0 days.

(21) Appl. No.: 11/156,285

(22) Filed: Jun. 16, 2005

(65) Prior Publication Data

US 2005/0287834 A1 Dec. 29, 2005

Related U.S. Application Data

(60) Provisional application No. 60/580,760, filed on Jun. 18, 2004.

(51) Int. Cl.
*H01R 12/00* (2006.01)

(52) U.S. Cl. ..... 439/67; 439/493; 439/637; 439/63

(58) Field of Classification Search ..... 439/67, 439/77, 493, 57, 499, 631, 494, 495, 632, 439/636, 637, 65, 492
See application file for complete search history.

(56) References Cited

U.S. PATENT DOCUMENTS 5,171,154 A * 12/1992 Casciotti et al. ..... 439/67
6,869,291 B1 * 3/2005 Norland et al. ..... 439/67
2005/0009382 A1 * 1/2005 Burmeister et al. ..... 439/67

OTHER PUBLICATIONS

MOLEX, "Molex Z-Axis Connector Update—Proposal for the AdvancedTCA Module Connector," Jun. 12, 2003, 16 pages.

Jörg Hehlans, Haring Electro-Optics, "AMC Flex Connector—People/Power/Partnership," Jun. 26, 2003, 34 pages.

PCI Industrial Computer Manufacturing Group, "Advanced Mezzanine Card Base Specification RC1.1," Dec. 3, 2004, 292 pages.

* cited by examiner

*Primary Examiner*—Tho D. Ta
(74) *Attorney, Agent, or Firm*—Squire, Sanders & Dempsey L.L.P.

(57) ABSTRACT

Embodiments of a connector (which may also be also referred to as a connector unit) are described. In accordance with one embodiment, the connector may comprise a case, first and second connectors, at least one stiffener bar, and at least one flexible circuit. The first connector may be located in a first opening of the case and the second connector may be located in a second opening of the case. The stiffener bar may be disposed in the case. The first connector may receive a first end of the flexible circuit while a second end of the flexible circuit may be interposed between the stiffener bar and the second connector.

24 Claims, 15 Drawing Sheets

Cross Section

Separator Assembled in the Case

Stiffener Bar Assembled in the Case

Compression Connector Assembled in the Case

Cross Section

Cross Section

Cross Section

Inside of the Case

Cross Section

Card Edge Connector Contacts Assembly

Card Edge Connector Contacts

Carrier Cut

Insert Molding

Card Edge Connector & FPC Assembly
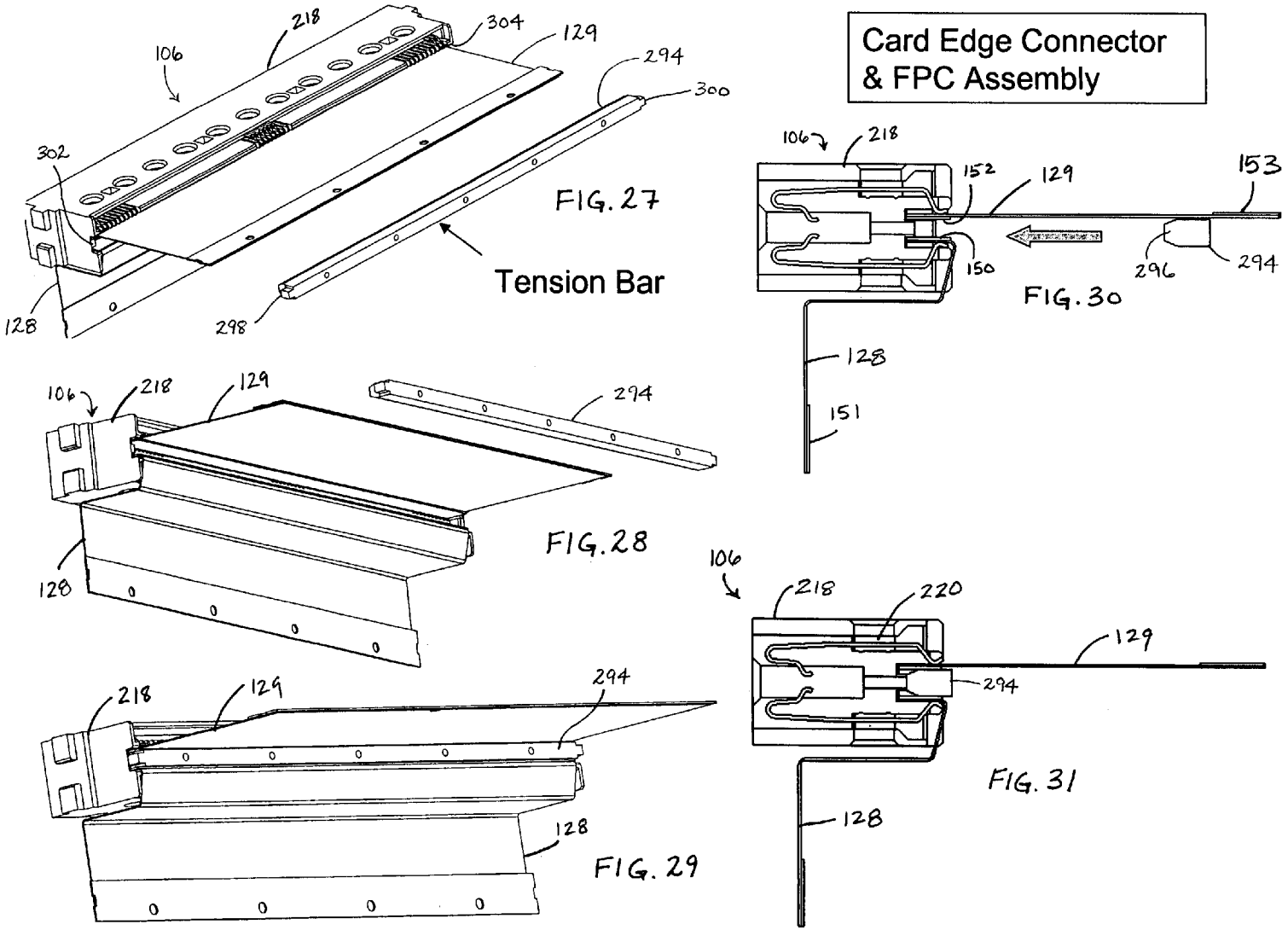

Compression Connector Contacts Assembly

Compression Connector Contacts Assembly

Compression Connector Contacts

Insert Molding

CONNECTOR FOR CONNECTING PRINTED CIRCUIT BOARDS

CROSS REFERENCES TO RELATED APPLICATIONS

This application claims the benefit of U.S. Provisional Application No. 60/580,760, filed Jun. 18, 2004 and which is incorporated by reference herein in its entirety.

TECHNICAL FIELD

Embodiments described herein relate generally to connectors and more particularly relate to connectors for connecting printed circuit boards and the like.

BACKGROUND

The PCI Industrial Computer Manufacturers Group (PICMG) Advanced Mezzanine Card (AMC) relates to a wide-range of high-speed mezzanine cards. AMC defines a modular add-on or "child" card that extends the functionality of a carrier board. Often referred to as mezzanines, these cards are called "AMC modules" or "modules." AMC modules lie parallel to and are integrated onto the carrier board by plugging into an AMC Connector. Carrier boards may range from passive boards with minimal "intelligence" to high performance single board computers.

AMC is designed to take advantage of the strengths of the PICMG 3.0 AdvancedTCA specification and the carrier grade needs of reliability, availability, and serviceability (RAS). The AMC module is designed to be hot swappable into an AMC Connector, seated parallel to the carrier board. A carrier face plate provides one or more openings through which the modules can be inserted into AMC bays. Module card guides support the insertion of the modules into the AMC connectors while the AMC bay provides mechanical support as well as EMI shielding. Connectivity between the AMC module and the carrier can be provided via an AMC connector that is attached to the carrier board. The AMC Connector resides on the carrier board at the rear of the AMC module.

SUMMARY

Embodiments of a connector (which may also be also referred to as a connector unit) are described. In accordance with one embodiment, the connector may comprise a case, first and second connectors, a separator, at least one stiffener bar, and at least one flexible circuit. The first connector may be located in a first opening of the case and the second connector may be located in a second opening of the case. The separator may be disposed in the case between the first and second connectors. The stiffener bar may be disposed in the case between the separator and the second connector. The first connector may receive a first end of the flexible circuit while a second end of the flexible circuit may be interposed between the stiffener bar and the second connector.

In one embodiment, the stiffener bar may have a slot that receives a stiffener plate (also referred to as a stiffener strip) therein. The stiffener strip may comprise a metal while the stiffener bar may comprise a material less conductive than the metal. The stiffener strip may also be located within the slot below a face of the stiffener strip in which the slot is formed.

In another embodiment, the stiffener bar and the flexible circuit may each have at least one hole therethrough with the second connector having at least one prong extending through the hole of the flexible circuit and into the hole of the stiffener bar. As an alternative or in combination with this embodiment, the second connector and the flexible circuit may each have the holes while the stiffener bar has the prong(s) extending through the hole(s) of the flexible circuit and into the hole(s) of the second connector.

In a further embodiment, the first connector may have an opening that receives the first end of the flexible circuit. In such an embodiment, a key (that may also be referred to as a tension bar) can be inserted into the opening to wedge the first end of the flexible circuit against at least one contact element of the first connector to thereby electrically couple the contact element(s) of the first connector to the first end of the flexible circuit.

In one implementation, the first connector may comprise a card slot connector adapted for receiving an edge of a circuit board therein. In another implementation, the second connector may comprise a compression connector that is adapted for being compressed between a circuit board and the stiffener bar.

In one embodiment, the case may have at least one channel therein and the second connector may have at least one latch extending into the channel. The channel may further have an aperture therein into which a hook of the latch can be extended.

In yet another embodiment, the connector unit can include two flexible circuits (i.e., first and second flexible circuits). In such an embodiment, the separator may be interposed between the first and second flexible circuits. As a further option, the connector may further have a pair of stiffener bars so that a first stiffener bar can be interposed between the first and second flexible circuits and a second flexible circuit can be interposed between the first and second stiffener bars.

In one embodiment, the first and/or second connectors may have a contact assembly that comprises a plurality of contact elements extending through a molding. The molding may have at least one extent extending into a receptacle in the at least one connector. The plurality of contact elements can be arranged into one or more groups along the molding. The group(s) of contact elements may be formed from a form that comprising a plurality of contact elements and a carrier with each of the contact elements having an end coupled to a carrier.

Embodiments of the connector may be used as part of a system to couple first and second circuit board. For example, in one embodiment, the first connector receiving a first circuit board while the case of the connector can be positioned adjacent a second circuit board so that the second connector and second end of the flexible circuit are pinched (and/or compressed and/or squeezed) between the stiffener bar and the second circuit board. A plate may also be provided that is positioned adjacent a face of the second circuit board opposite the connector. At least one fastener may be extended through the connector, second circuit board and the plate to couple the connector, second circuit board and plate together with the tightening of fastener to provide a force to urge the second circuit board and the case together and thereby pinch/compress the second connector and second end of the flexible circuit between the stiffener bar and the second circuit board.

In use, embodiments of the connector/connector unit may be utilized in a method where a first circuit board can be inserted into a first connector of the connector unit. In this method, a first face of a second circuit board may be positioned against the connector unit adjacent a second connector of the connector unit. A plate may be positioned adjacent a second face of the second circuit board opposite the first face of the second circuit board and at least one fastener may be extended through the connector unit, second circuit board and the plate to urge the second circuit board towards the connector unit so that the second connector is pinched between the second circuit board and a stiffener bar in the connection unit.

BRIEF DESCRIPTION OF THE DRAWINGS

FIG. 27 is a schematic exploded perspective view of a card edge connector component, a pair of flexible printed circuits and a tension bar in accordance with an exemplary AMC embodiment;

FIG. 28 is a schematic exploded perspective view of the exemplary card edge connector component, flexible printed circuits and tension bar shown in FIG. 27 as seen from below;

FIG. 29 is a schematic perspective view illustrating the arrangement of the exemplary card edge connector component, flexible printed circuits and tension bar shown in FIG. 27 when assembled together;

FIG. 30 is an exploded cross sectional view of the exemplary assembly shown in FIG. 29 illustrating the insertion of a tension bar;

FIG. 31 is an exploded cross sectional view of the exemplary assembly shown in FIG. 29.

DETAILED DESCRIPTION

Embodiments of a connector unit (also referred simply as a "connector") described herein may be may be used to connect multiple circuit boards, such as printed circuit boards, together with the connector having a separate connection (i.e., individual connectors) to each board. The connector may also include one or more flexible printed circuits or flexible material cables that connect the separation connections together.

U.S. Provisional Application No. 60/580,760, filed Jun. 18, 2004 is incorporated by reference in the present specification in its entirety. Many of the embodiments described herein are described in the context of an exemplary Advanced Mezzanine Card (AMC) embodiment that has a standard defined by the PCI Industrial Computer Manufacturers Group (PICMG). The operating characteristics of the AMC are described in a document entitled "Advanced Mezzanine Card Base Specification" which was produced by the PICMG, Dec. 3, 2004 as the PICMG AMC.0 Specification, RC1.1 (also referred to as PICMG AMC.0 RC1.1), this document being hereby incorporated by reference in its entirety.

Figure 1:
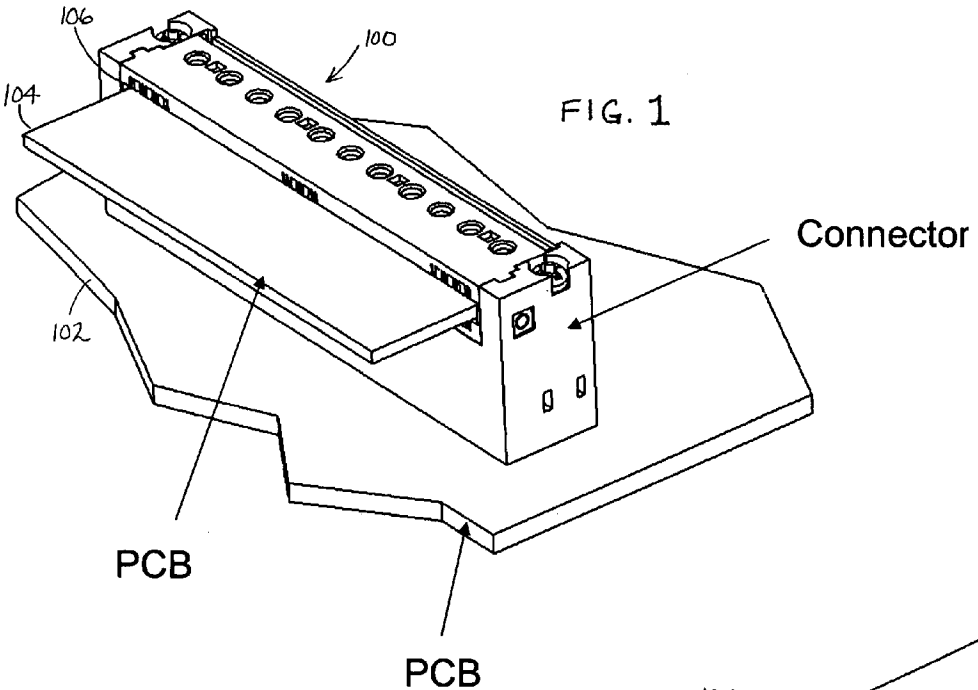
FIG. 1 is a schematic perspective view of a connector connecting two printed circuit boards (PCBs) in accordance with an exemplary AMC embodiment.
Figure 2:
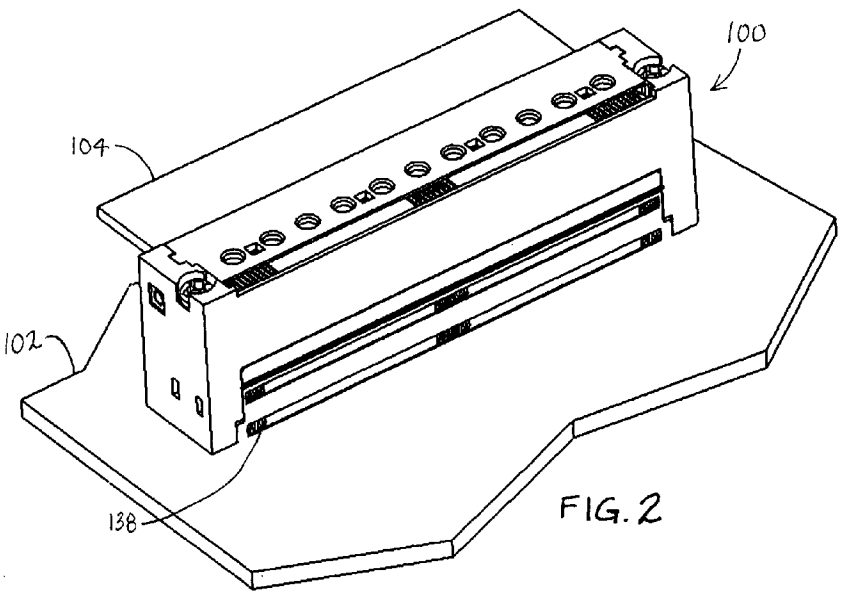
FIG. 2 is a schematic perspective view of the exemplary AMC embodiment shown in FIG. 1 taken from an opposite side of the connector.

FIG. 1 shows a connector/connection unit 100 connecting two printed circuit boards 102, 104 (PCBs) in accordance with an exemplary AMC embodiment. FIG. 2 shows the connector 100 from an opposite side than that shown in FIG. 1. In the exemplary AMC embodiment depicted in FIGS. 1 and 2, the connector 100 is mounted to one of the PCBs that may be referred to as the AMC carrier 102. The connector 100 also has a receptacle referred to as a card edge connector 106 that receives one edge of the other PCB that is referred to as the AMC (plug-in) module or component 104. To help facilitate understanding of the present specification, the side of the connector 100 having the card edge connector 106 receiving the module 104 will be referred to as the module side or front side of the connector 100 while the side opposite the module side will be referred to as the back or rearwards side of the connector 100.

Figure 3:
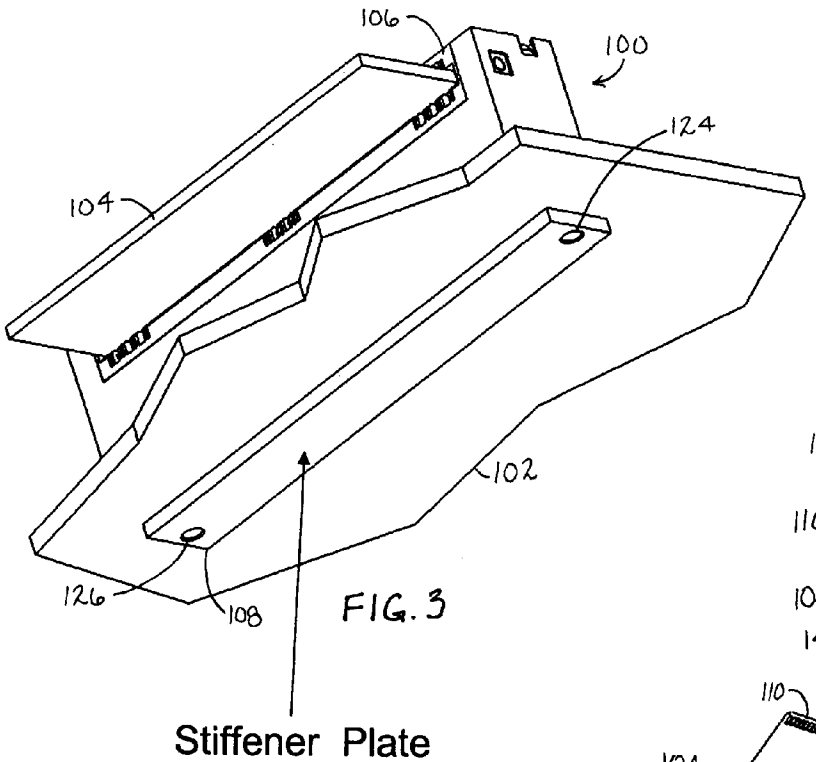
FIG. 3 is a schematic perspective view of the exemplary AMC embodiment shown in FIG. 1 as seen from a bottom face of the carrier and showing a stiffener plate.

FIG. 3 shows the connector 100 and PCBs 102, 104 from below the carrier 102. As shown in FIG. 3, the connector 100 may be mounted to the carrier 104 in conjunction with a stiffener plate 108 located on the bottom face of the carrier. In one implementation, the stiffener plate may be constructed from some sort of metal. In another implementation, the stiffener plate may be constructed from a relatively rigid polymer and/or plastic material.

Figure 4:
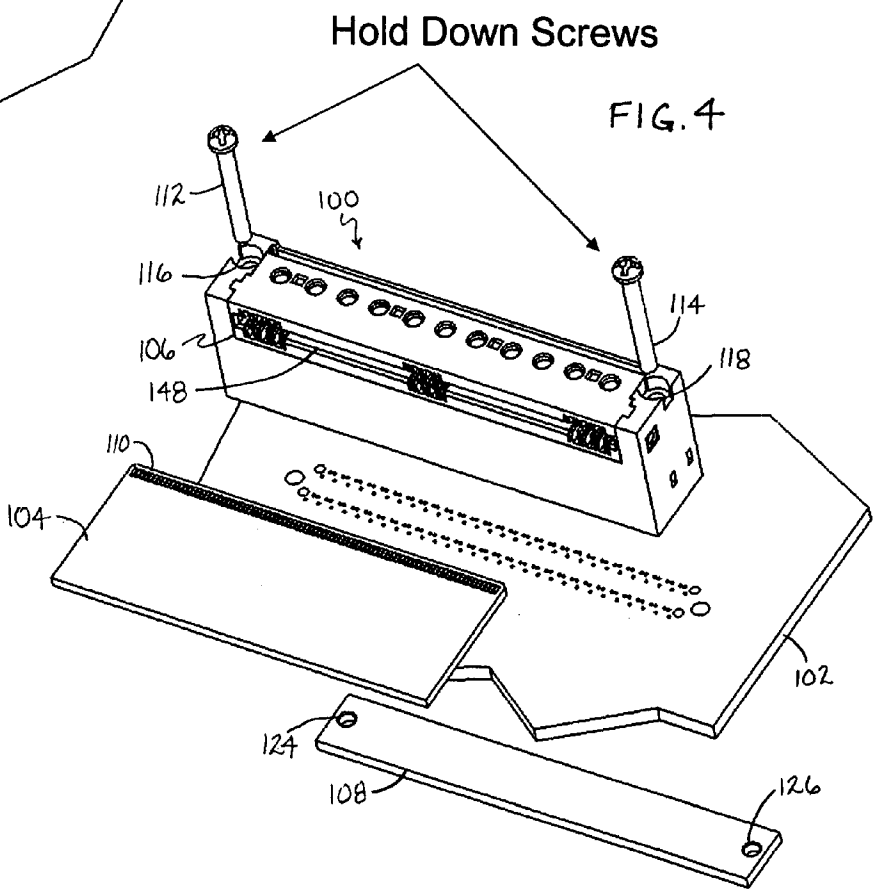
FIG. 4 is a schematic exploded perspective view of the exemplary AMC embodiment shown in FIG. 1 with the card edge of the module removed from the card edge connector of the connector.

FIG. 4 shows an exploded view of the connector 100, PCBs 102, 104 and stiffener bar 108 shown in FIGS. 1–3 with the card edge 110 of the module 104 removed from the card edge connector 106 of the connector 100. As shown in FIG. 4, the connector 100 may be mounted to the carrier 102 by a pair of hold down screws 112, 114 (i.e., threaded fasteners) that are extended through corresponding mounting bores 116, 118 in the carrier 102 and matching mounting holes 120, 122 through the carrier 102. The stiffener plate 108 also has a pair of holes 124, 126 that are arranged with the same spacing as the mounting holes 120, 122 of the carrier 102 so that the holes 124, 126 of the stiffener plate 108 can be aligned with the mounting holes 120, 122 of the carrier 102 to permit passing of the hold down screws through them. The holes 124, 126 of the stiffener plate 108 may be threaded so that they are capable of engaging the threads of hold down screws 112, 114 and hold in place together the connector 100, the carrier 102 and the stiffener plate 108. As an alternative (or in addition) to the threaded holes 124, 126, nuts can be provided to secure the screws 112, 114 and hold the connector 100, carrier 102 and stiffener plate 108 in place.

Figures 5, 6:
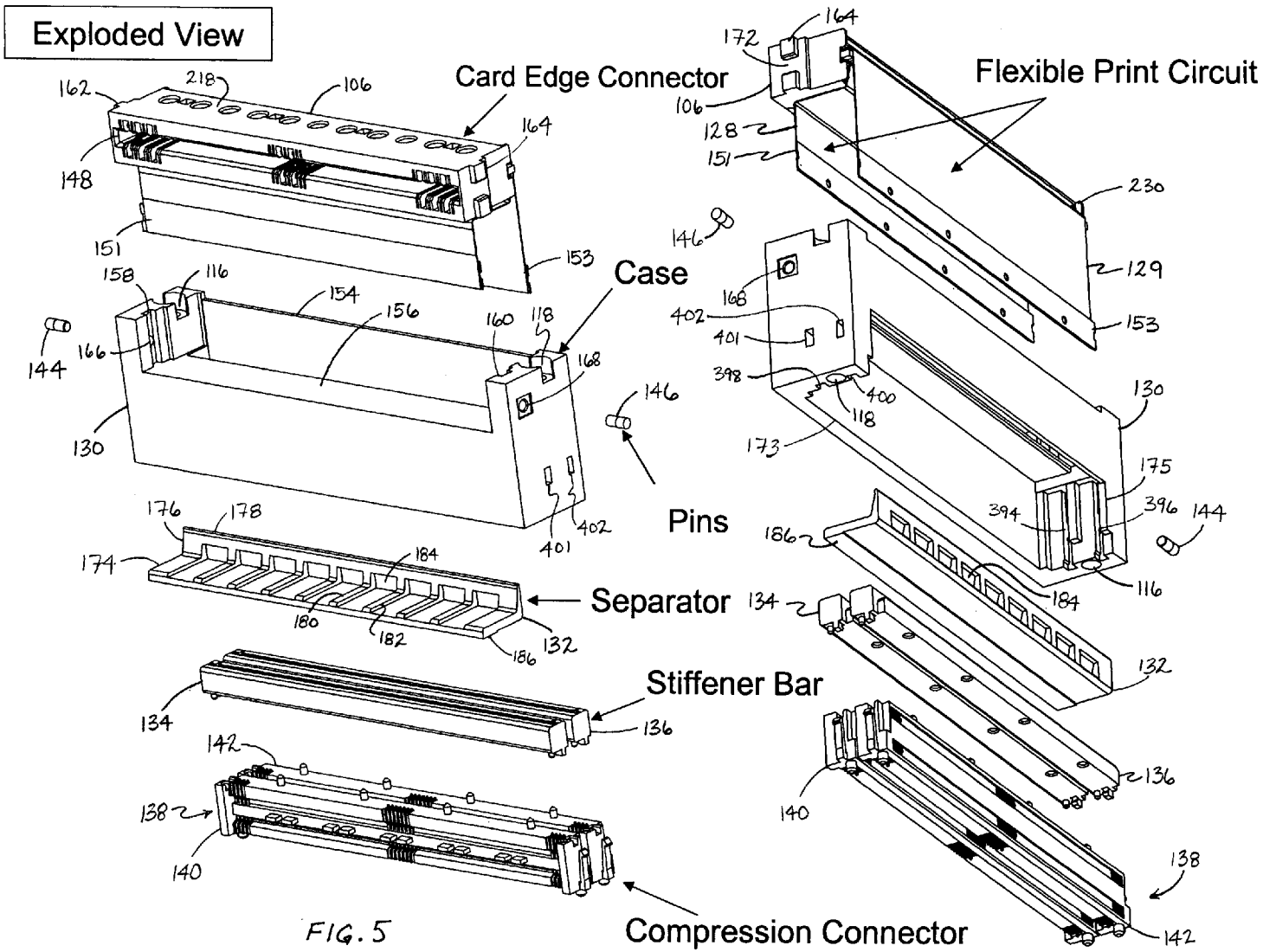
FIG. 5 is a schematic exploded perspective view of a connector in accordance with an exemplary AMC embodiment.
FIG. 6 is a schematic exploded perspective view of the exemplary connector shown in FIG. 5 as seen from an opposite direction.

FIGS. 5 and 6 show exploded views of a connector 100 in accordance with an exemplary AMC embodiment. As shown in FIGS. 5 and 6, the connector 100 may be composed of several components including a card edge connector 106, a pair of flexible printed circuits 128, 129 (FPCs), a case 130 (or housing), a separator 132, a pair of stiffener bars 134, 136, and a compression connector 138 formed by a pair of compression connector components 140, 142. The connector 100 may also include a pair of fastening pins 144, 146. In use, the various individual components assembled inside case can help to provide a floating condition for the connector and thereby help ensure the tolerance of each board location.

The card edge connector 106 may have a card slot 148 for receiving a module 104 therein.

Each FPC 128, 129 may have a pair of opposite ends with each end having a contact 150, 151, 152, 153 (which may also be referred to as signal pads). The upper contacts 150, 152 of the FPCs 128, 129 may be inserted into and/or coupled the card edge connector 106 so that the lower contacts 151, 153 of the FPCs 128, 129 depend from the card edge connector component 106. In at least one embodiment, an FPC may comprise a printed circuit or conductive pattern placed on, or between, insulating layers which remain flexible after processing. In one implementation, a FPC may comprise a high performance, high speed FPC, known as a YFlex. As an alternative to FPCs, an embodiment of the connector 100 may be implemented using flexible material cables in their place.

The case 130 has an upper opening 154 for receiving the card edge connector 106 and the FPCs 128, 129. The case 130 may also include a ledge 156 on the module side of the connector 100 on which the card edge connector 106 can rest when inserted into the upper opening 154. The case 130 may also include a pair side grooves 158,160 that are adapted for receiving corresponding ridges 162, 164 on ends of the card edge connector 106 to help position the card edge connector 106 when it is inserted into the upper opening 154 of the case 130. The case may also include holes 166,168 for receiving the fastening pins 144, 146. The ridges 162, 164 of the card edge connector 106 may also include spaces 170, 172 or breaks for receiving ends of the fastening pins 144, 146 when the fastening pins 144, 146 are inserted into the holes 166,168 to help hold the card edge connector in a relatively fixed position when inserted into the upper opening of the case. As shown in FIG. 6, the case also includes a lower opening 173 in the bottom of the case that also has a side region 175 extending into a lower region of a back side of the case (i.e., the side of the case opposite the module side of the connector).

The separator 132 has a generally L-shaped configuration with a generally horizontal lower portion 174 and a generally vertical upper portion 176. The upper portion 174 may taper towards its upper edge 178 so that the upper portion has a generally triangular-shaped transverse cross section profile. An upper face of the separator 132 may include a plurality of transverse spines (e.g., spines 180, 182) for helping to enhance the stiffness and rigidity of the separator 132. The transverse spines may be arranged on the upper face of the separator 132 so that the spines are evenly spaced apart and in substantially parallel in alignment to one another. The upper portion 176 of the separator 132 may further include holes (e.g., hole 184) therethrough between adjacent pairs of spines (e.g., spines 180, 182). As an alternative to these holes, the upper portion 176 of the separator 132 may instead include corresponding depressions in both faces of the upper portion of the separator (at the same positions as the holes). In either embodiment, the holes/depressions may help to reduce the weight and material used in the separator 132 without reducing the overall strength of the upper portion 176. A bottom face of the lower portion 174 of the separator 132 may include a thickened or reinforced region 186 on that extends along an outer edge of the lower portion 174 to provide additional strength and stiffness to the lower portion 174 of the stiffener 132.

Figure 8:
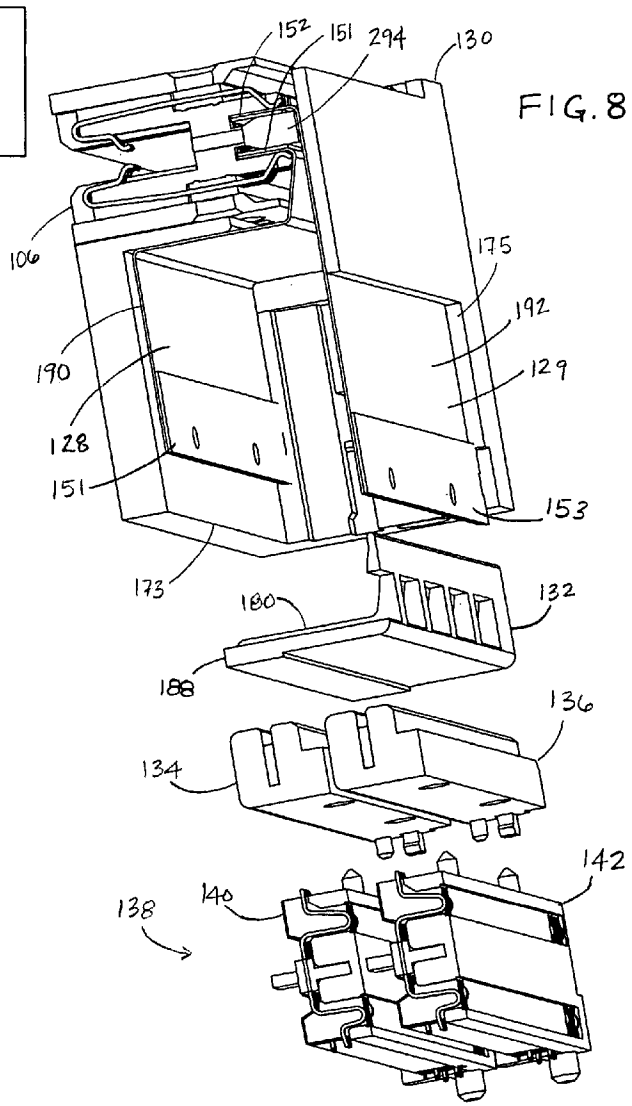
FIG. 8 is a schematic transverse cross sectional view of a partially exploded view of the exemplary connector shown in FIG. 7 as seen from a different angle.
Figure 7:
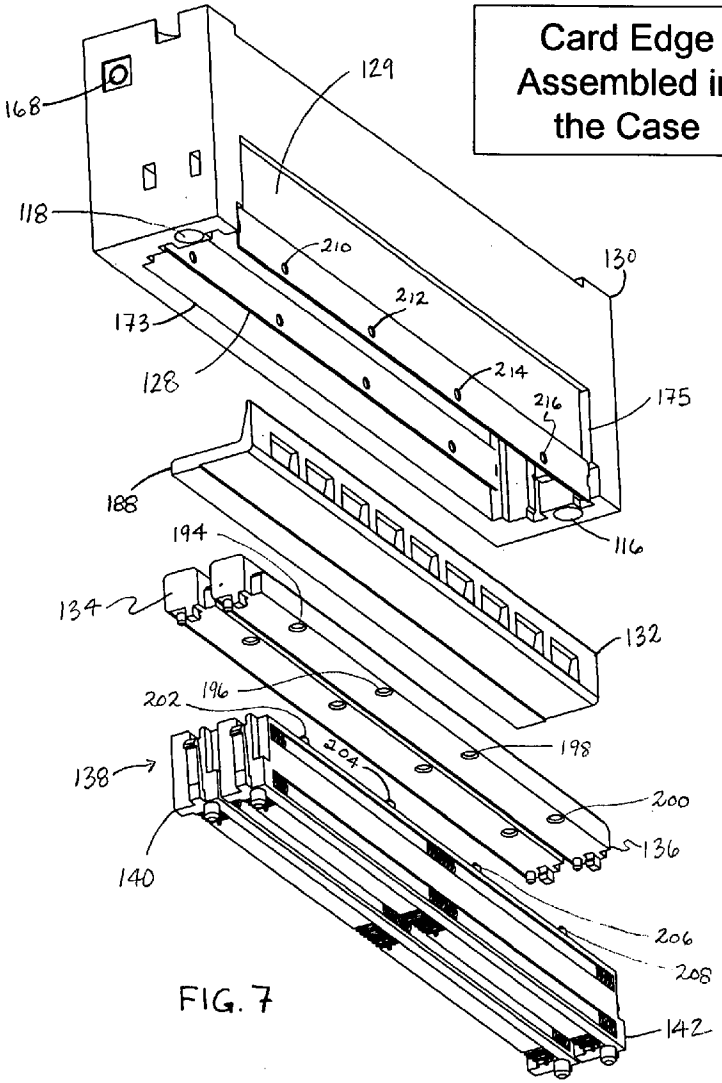
FIG. 7 is a schematic partially exploded perspective view of a connector in accordance with an exemplary AMC embodiment illustrating the position of a card edge component when inserted into a case.

FIGS. 7 and 8 show the position of the card edge component 106 when inserted into the case 130 in an exemplary AMC embodiment. As best shown in FIG. 8, the card edge component 106 and FPC 128 may be inserted into the upper opening 154 of the case 130 so that the card edge component 106 is positioned adjacent the ledge 156 of the case 130. When inserted into the case 130, the lower ends 151, 153 of the FPCs 128, 129 may extend into the case 130 so that one of the ends 151 (i.e., the lower end of the front FPC 128) extends along a bottom side of the ledge 156 and downwards internally along the module side of the case 130 while the other end 153 (i.e., the lower end of the back FPC 129) depends along an opposite internal side of the case 130 so that at least a portion of this end 153 is exposed by the lower opening 173 of the case 130.

Figure 9:
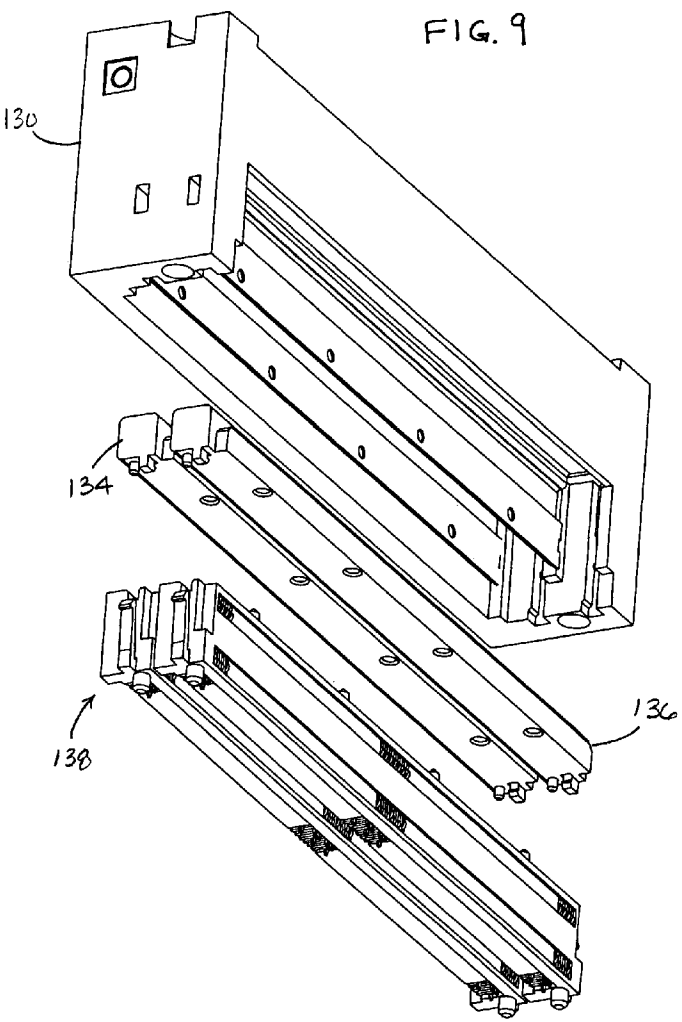
FIG. 9 is a schematic partially exploded perspective view of a connector in accordance with an exemplary AMC embodiment illustrating the position of a separator when inserted into a case.
Figure 10:
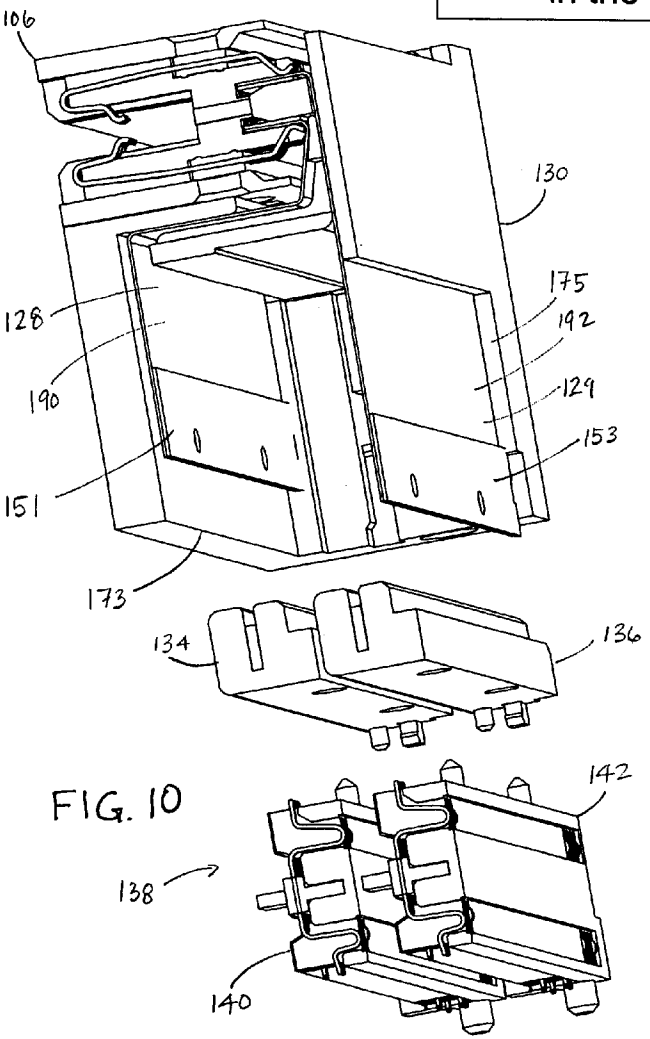
FIG. 10 is a schematic transverse cross sectional view of a partially exploded view of the exemplary connector shown in FIG. 9.

FIGS. 9 and 10 show the position of the separator 132 when inserted into the case 130 in an exemplary AMC embodiment. In use, the separator 132 helps to maintain sufficient clearance between the two FPCs 128, 129 inside the case 130. With inserted into the case 130, the upper portion 176 of the separator 132 may extend upwards behind the ledge 156 of the case 130 and separates the two FPCs 128, 129 apart from each other. In this position, a forwards portion 190 of the FPC 128 that is proximate to the lower end contact 151 of the FPC 128 may be sandwiched between the bottom of the ledge 156 and the lower portion 174 of the separator 132. The forwards edge 188 of the lower portion 174 of the separator 132 may help to keep the lower end 151 of the FPC 128 close to module side in the case 130 and in a spaced apart relationship with the lower end 153 of the other FPC 129.

Figures 11, 12:
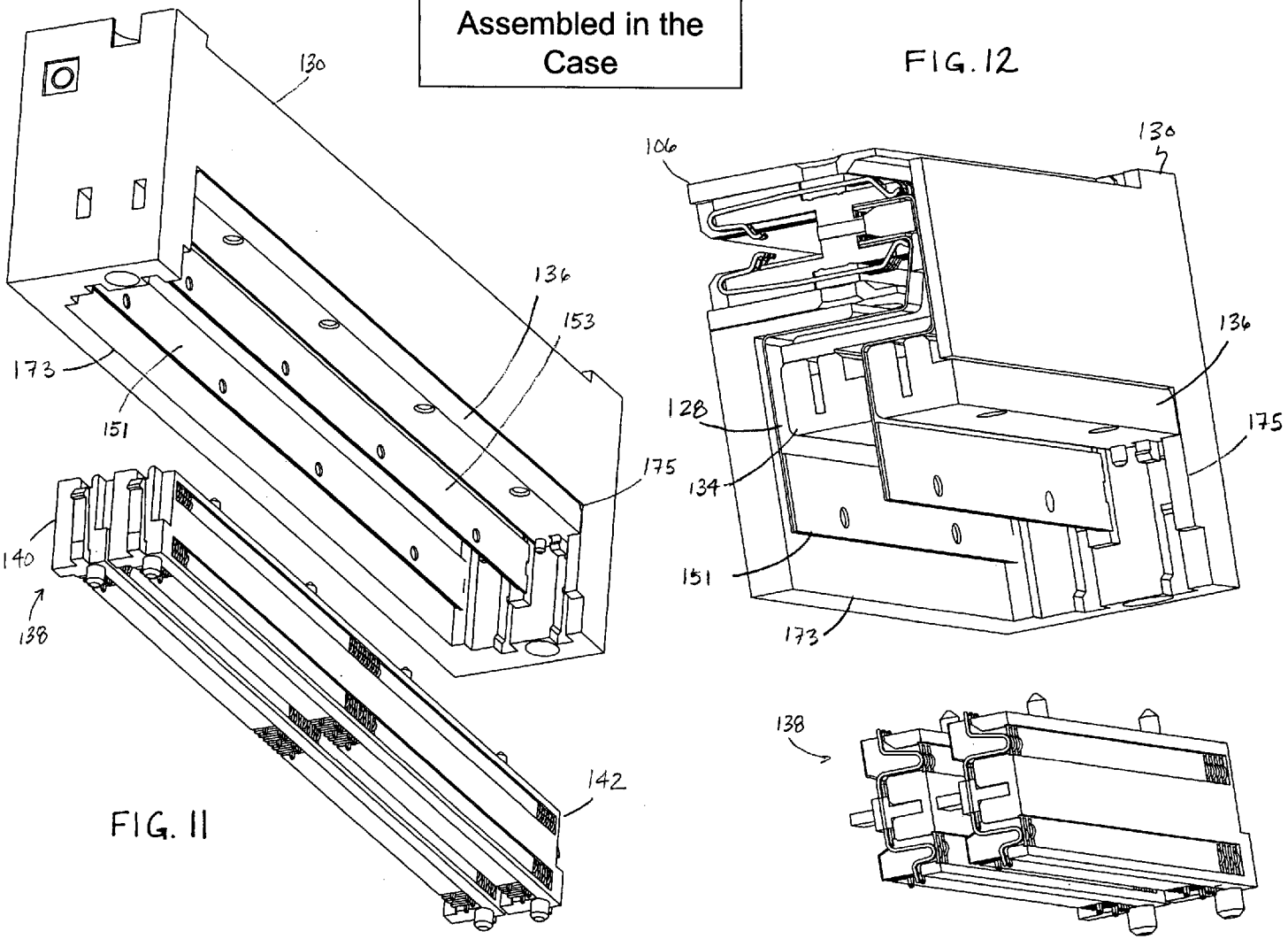
FIG. 11 is a schematic partially exploded perspective view of a connector in accordance with an exemplary AMC embodiment illustrating the position of stiffener bars when inserted into a case.
FIG. 12 is a schematic transverse cross sectional view of a partially exploded view of the exemplary connector shown in FIG. 11.

FIGS. 11 and 12 show the position of the stiffener bars 134, 136 when inserted into the case 130 in an exemplary AMC embodiment. In use, the stiffener bars 134, 136 may help to counterbalance the stiffener plate 108. (located under the compressive part of the carrier board 102 and may thereby help to control warping of the connector 100 and the printed circuit board 102 and well as help facilitate easier insertion of the module(s) 104 into the card slot 106. The stiffener bars 134, 136 may be positioned in the case 130 so that they are each positioned beneath lower portion 174 of the separator. The front stiffener bar 134 may be positioned in the case 130 so that the forwards portion 190 of the FPC 128 is interposed between the front stiffener bar 134 and the inside of the front side of the case 130 that defines the module side of the connector 100. The back stiffener bar 136 may be positioned inside the case 130 so that a lower portion 192 of the FPC 128 that is proximate of the back end 152 of the FPC 128 is interposed between the back stiffener bar 136 and the lower portion 174 of the separator 132 and between the two stiffener bars 134, 136 in what may be described as an inverted L-shaped configuration.

Figure 14:
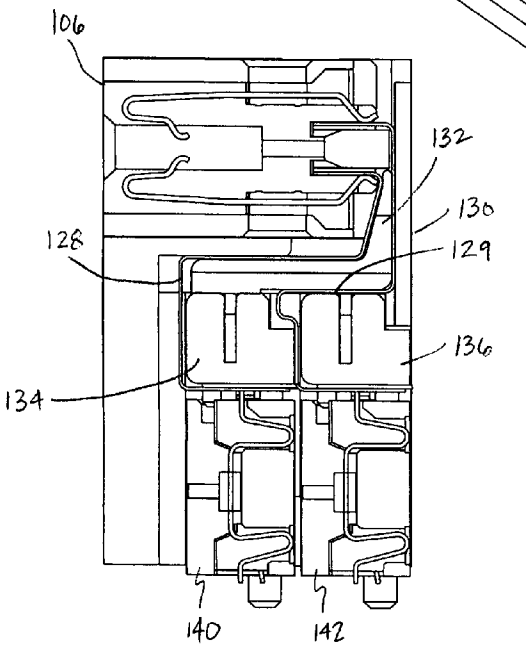
FIG. 14 is a schematic transverse cross sectional view of the exemplary connector shown in FIG. 13.
Figure 15:
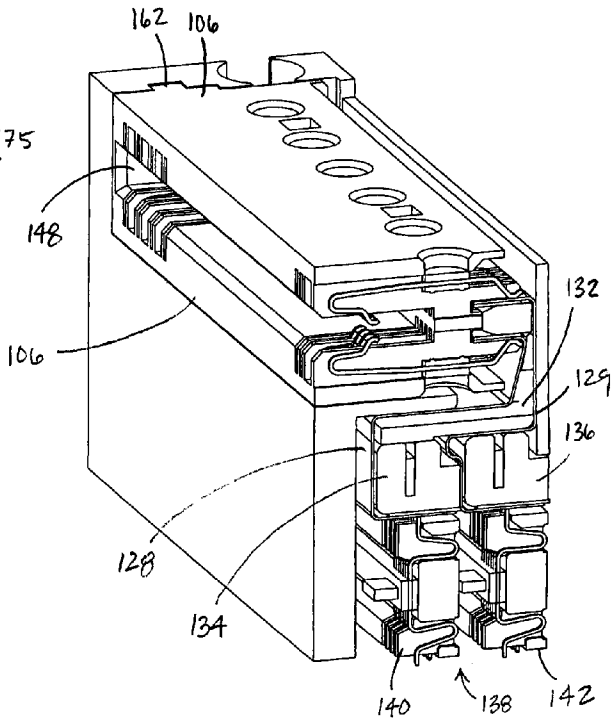
FIG. 15 is a schematic transverse cross sectional perspective view of the exemplary connector shown in FIG. 13.
Figure 17:
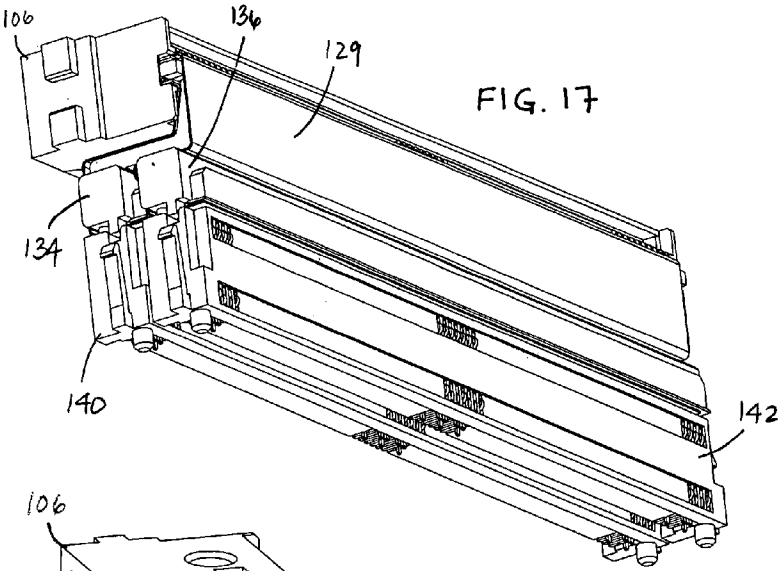
FIG. 17 is a schematic perspective view of the exemplary connector components shown in FIG. 16 as seen from an opposite direction.
Figure 19:
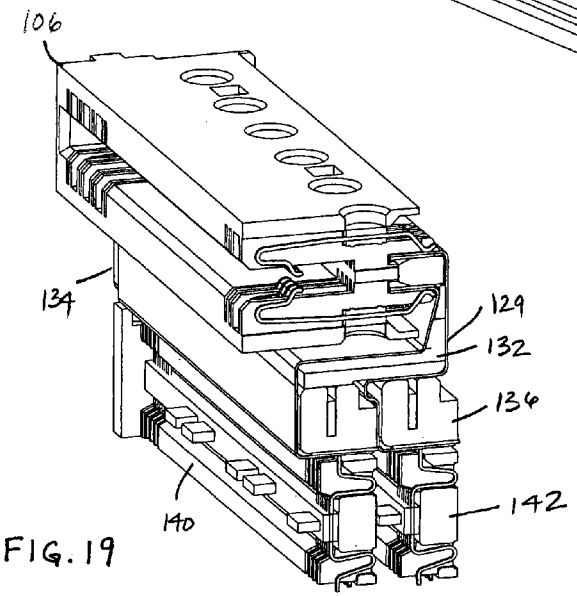
FIG. 19 is a schematic transverse cross sectional perspective view of the exemplary connector components shown in FIG. 16.
Figure 16:
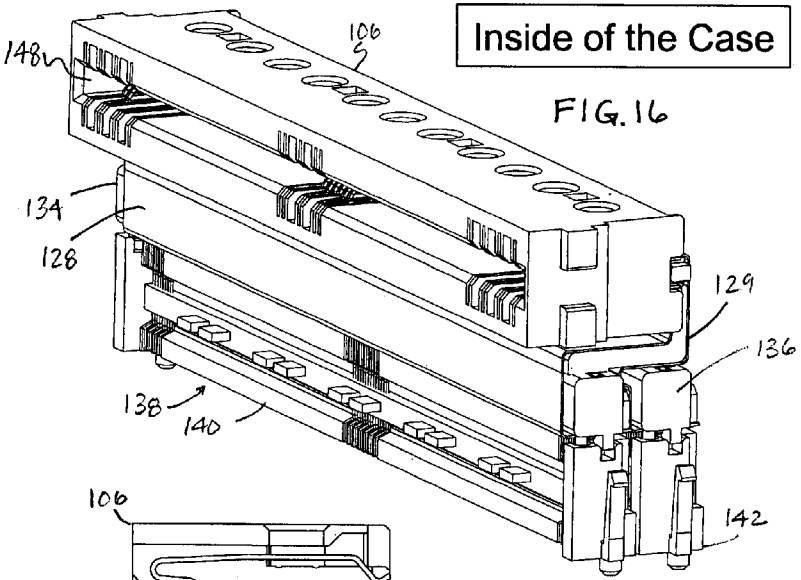
FIG. 16 is a schematic perspective view of a connector in accordance with an exemplary AMC embodiment without an outer case to show the positioning of the other components of the connector inside the case.
Figure 18:
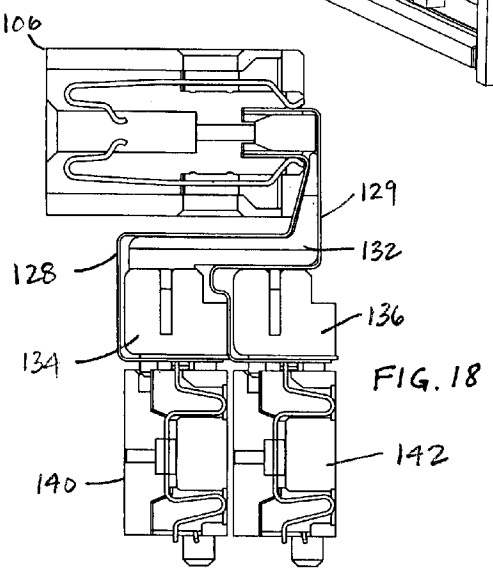
FIG. 18 is a schematic transverse cross sectional view of the exemplary connector components shown in FIG. 16.

As best represented by the back stiffener bar 136 in FIGS. 11 and 12, the bottom side of each of the stiffener bars 134, 136 may have a plurality of spaced apart apertures 194, 196, 198, 200 therein. Correspondingly, the top sides of each of the compression connector components 140, 142 may have a plurality of upwardly extending prongs (e.g., prongs 202, 204, 206, 208 of compression connector component 142) with the prongs (also referred to as pins) 202, 204, 206, 208 being spaced apart to have a similar spacing as that between the apertures 194, 196, 198, 200 of the stiffener bars 134, 136 so that the prongs 202, 204, 206, 208 can be inserted into the apertures 194, 196, 198, 200. As an alternative (or in combination therewith), a converse arrangement can be provided where the prongs are located on the stiffener bars 134, 136 (i.e., downwardly extend from the stiffener bars) and the holes for receiving the prongs are located in the top of the compression connector components 140, 142. Each of the lower contacts 151, 153 of the FPCs 128, 129 may also have a similar number of holes (e.g., holes 210, 212, 214, 216 of contact 153) therethrough arranged with similar spacing as the apertures in the stiffener bars 134, 136 (e.g., apertures 194, 196, 198, 200) and the prongs of the compression connector components 140, 142 (e.g., prongs 202, 204, 206, 208) so that the prongs can also be extended through the holes of an adjacent lower contact 151, 153 (e.g., holes 210, 212, 214, 216 for contact 153) with the FPCs 128, 129 located between the compression connector components 140, 142 and the stiffener bars 134, 136 as best shown in FIGS. 14 and 15. This arrangement of the apertures (e.g., apertures 194, 196, 198, 200), prongs (e.g., prongs 202, 204, 206, 208) and holes (e.g., holes 210, 212, 214, 216) can thus be used to help align the FPCs contacts 151, 153 with the contacts elements (e.g., contact element 312) of the compression connector 138, with the prongs helping to correct or prevent errors in alignment.

Figure 13:
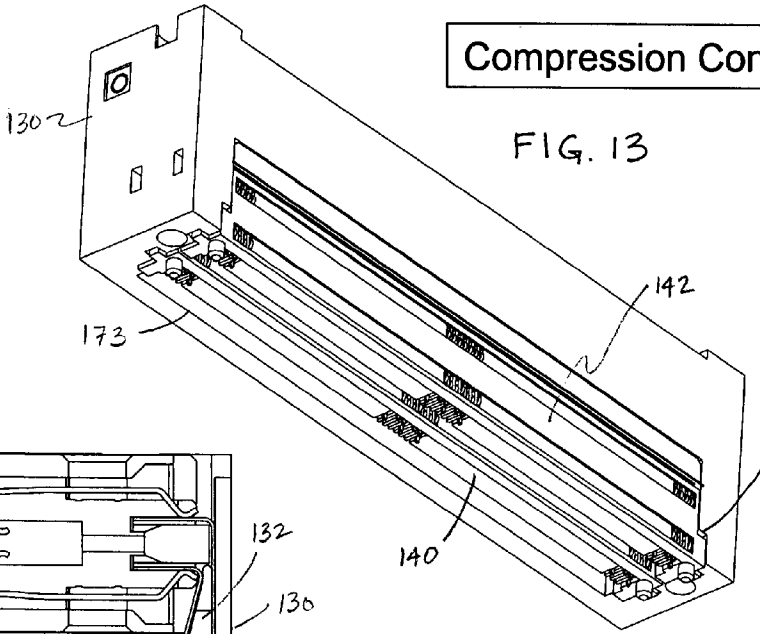
FIG. 13 is a schematic perspective view of a fully assembled connector in accordance with an exemplary AMC embodiment.

FIGS. 13, 14 and 15 show a fully assembled connector 100 in accordance with an exemplary AMC embodiment. FIGS. 16, 17, 18 and 19 show the exemplary connector 100 with the case removed so that the components inside the case can be better seen in their assembled arrangement. In the fully assembled connector 100, the compression connector components 140, 142 may be inserted into the case 130 so that they are each positioned beneath an associated one of the stiffener bar 134, 136.

As best shown in FIGS. 14, 15, 18 and 19, the front and lower portions 190, 192 of the FPCs 128, 129 may be folded or bent so that the lower contact 151 of the front FPC 128 is interposed between the front stiffener bar 134 and the front compression contact component 140 and the lower contact 153 of the back FPC 129 is interposed between the back stiffener bar 136 and the front compression contact component 142. In this configuration, the apertures in each stiffener bar 134, 136 (e.g., apertures 194, 196, 198, 200) and holes of the adjacent lower contact 151, 153 (e.g., holes 210, 212, 214, 216 of contact 153) may be aligned together so that a corresponding one of the prongs of the adjacent compression connector components 140, 142 (e.g., prongs 202, 204, 206, 208) is extends through the hole and into the aperture of its associated aperture-hole aligned pair (e.g., prong 202 may be extended through hole 210 and into aperture 194).

As best shown in FIG. 13, the back stiffener bar 136 and the back compression connector component 142 may be positioned in the case 130 so that back side portions (i.e., back portions) of both the back stiffener bar 136 and the back compression connector component 142 are exposed by the side region 175 of the lower opening 173 that extends into the lower region of the back side of the case 130 while bottom portions of the compression connector components 140, 142 are exposed by the region of the lower opening 173 in the bottom of the case 130.

FIGS. 20–31 show the assembly of the card edge connector 106 and FPCs 128, 129 in accordance with an exemplary AMC embodiment. As shown in FIGS. 20–23, the assembly of the card edge connector 106 includes a casing or housing 218 and a pair of contact assemblies 220, 222.

The card slot 148 of the card edge connector 106 may be formed in a front face 224 of the casing 218. The card slot 148 may have a generally rectangular periphery with longer upper and lower edges and shorter lateral ends. The casing 218 have include a pair of longitudinal side walls 226, 227 that may extend from the upper and lower edges of the card slot to an open back 230 of the casing 218. The side walls may also define upper and lower channels 228, 229 inside the casing 218 above and below the card slot 148. The card slot 148 may also include a several groups of contact slots 232, 234, 236, 238, 240, 242 (with each group of contact slots comprising one or more contact slots (e.g., contact slot 243)) that extend across each of the longitudinal side walls 226, 227 from the front face 224 to the open back 230 of the casing 218. As depicted in the exemplary embodiment shown in FIGS. 20–22, the groups of contacts slots may be arranged so that they are grouped together into one or more adjacently aligned upper and lower groups. The exact arrangement of the groups 232, 234, 236, 238, 240, 242 as well as the arrangement of the individual contact slots in each group may be dependent on the desired implementation.

The casing 218 may include the ridges 162, 164 and spaces/breaks 170, 172 form on the ends of the card edge connector 106. In addition, an upper face 244 of the casing 218 may include a plurality of circular and rectangular (or square) upper holes (e.g., upper holes 246, 248). Similarly, a lower face 245 of the casing 218 may include similar holes (e.g., hole 249).

Each of the contact assemblies 220, 222 comprises an insert molding 250 and a plurality of contacts (e.g., contact 252) extending through the insert molding 250. The contact may be grouped together in one or more groups of contacts 254, 256, 258 (with each group comprising one or more contacts).

Figure 24:
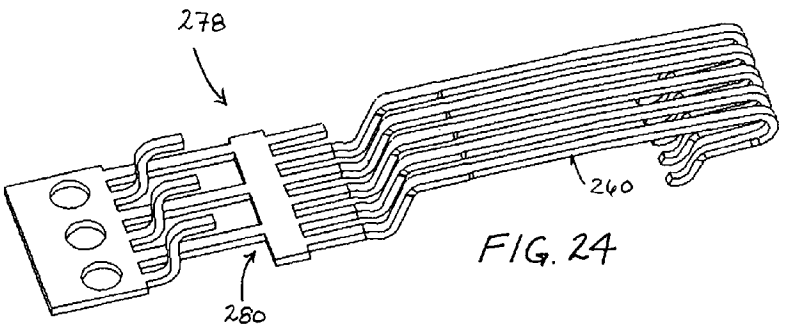
FIG. 24 is a schematic perspective view of an exemplary contact element for a card edge connector in accordance with an exemplary AMC embodiment.
Figure 26:
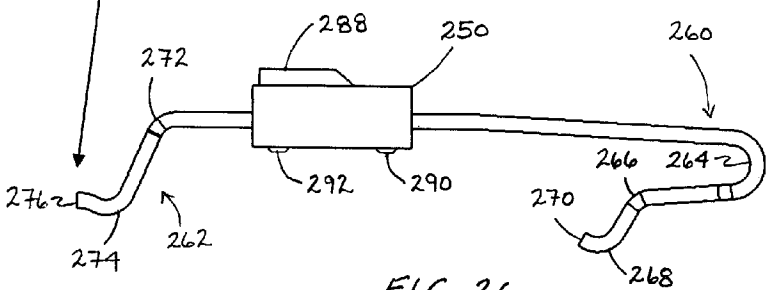
FIG. 26 is a schematic side view of the exemplary contact assembly shown in FIG. 25.

Each contact (e.g., contact 252) may have opposite front and back end regions 260, 262 extending from opposite longitudinal sides of the insert molding 250. The front end region 260 may include a serpentine end region comprising a hairpin turn 264 and an S-shaped curve having two bends 266, 268 that terminates adjacent a front end 270 of the contact 252. The back end region 262 may include a plurality of opposing curves or bends 272, 274 and terminate at a back end 276 of the contact 252. In one implementation, the front and back regions 260, 262 of each contact may be resiliently deflectable and each contact may be constructed out of a conductive material (such as, e.g., some sort of metal). With reference to FIG. 24, in manufacture, a group of contacts 278 may be formed with a carrier 280 (see FIG. 24) that extends from the back ends 276 of the contacts in the group 278. The carrier 280 may be cut off from the group of contacts 278 with the cut end forming the back ends of the contacts (e.g. back end 276). Using this implementation for forming the contacts, the contacts may be formed with very short (or no) stubs on their back ends 276 for use in high speed applications. Having stubs on the back ends 276 can result in interference signals being generated as a result of a signal going up a stub and then coming back to down to cause interference with the next signal. As a result, using the embodiment shown in FIG. 24 to form the contact elements of a card edge connector may be advantageous in certain implementations.

Figures 20, 21, 22, 23:
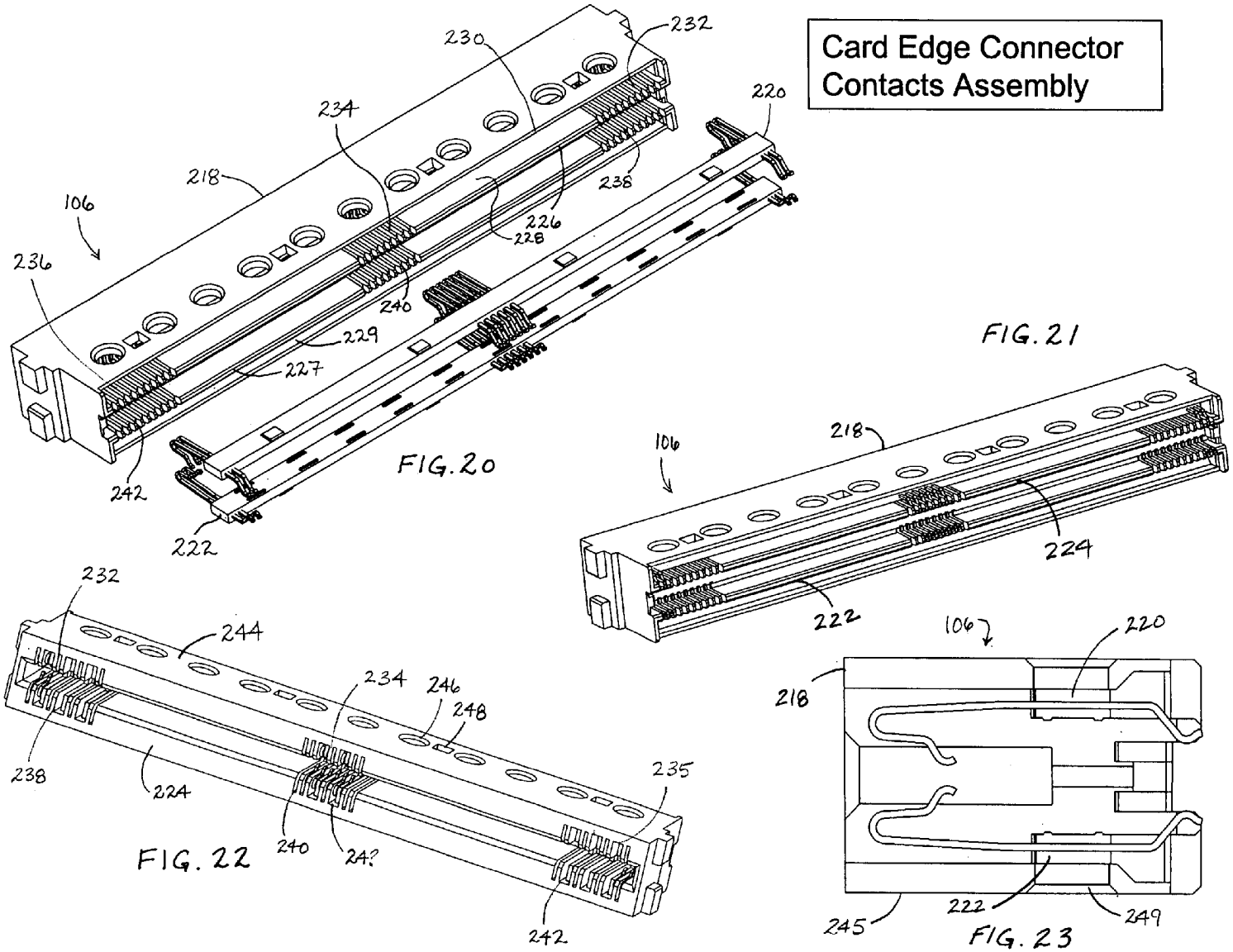
FIG. 20 is a schematic exploded perspective view of an assembly of a card edge connector component in accordance with an exemplary AMC embodiment.
FIG. 21 is a schematic perspective view of the exemplary assembly shown in FIG. 20 as assembled.
FIG. 22 is a schematic perspective view of the exemplary assembly shown in FIG. 21 as seen from an opposite direction.
FIG. 23 is a schematic transverse cross sectional view of the exemplary assembly shown in FIG. 21.

Each contact assembly 220, 222 may be inserted into a corresponding channel 228, 229 in the casing 218 so that each contact (e.g., contact 252) of a given contact assembly 220, 222 extends into a corresponding contact slot (e.g., contact slot 243) in the adjacent side wall 226, 227 of the card slot 148 with the front end regions 260 of the contacts extending towards the front face 224 of the casing 218 and the back end regions 262 extending towards the back 230 of the casing 218. As shown in FIGS. 21 and 22, embodiments may be implemented where the number of contact slots in a given side wall 226, 227 are greater than the number of contacts of the associated contact assembly 220, 222 inserted into the adjacent channel 228, 229 in the casing 218.

As best depicted in the cross section shown in FIG. 23, the contact assemblies 220, 222 may be orientated in their respective channel 228, 229 so that front end regions 260 of their contacts generally face each other and the outermost bend 274 of the back end regions 262 of the contacts generally face each other.

Figure 25:
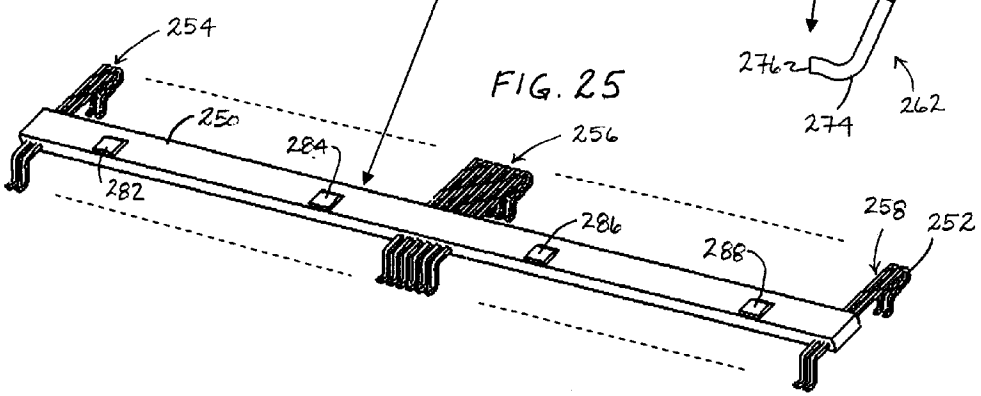
FIG. 25 is a schematic perspective view of a contact assembly of a card edge connector in accordance with an exemplary AMC embodiment.
Figure 33:
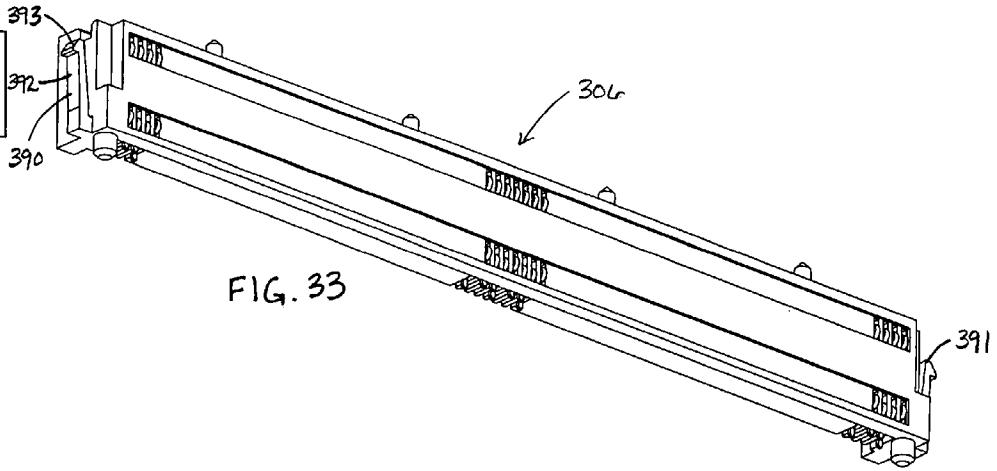
FIG. 33 is a perspective view of the exemplary compression connector component shown in FIG. 32 as seen from an opposite direction.

The insert molding 250 of each contact assembly 220, 222 may have a plurality of studs 282, 284, 286, 288 that, as shown in FIG. 25, may have a generally rectangular or trapezoidal contour. When the contact assemblies 220, 222 are inserted into the casing 218, the studs of the contact assembly 220 inserted into the upper channel 228 of the casing 218 may be extended into at least a portion of upper holes of the casing 218 (e.g., the rectangular holes 248 in the casing) while the studs of the contact assembly 222 inserted into the lower channel 229 of the casing 218 may similarly extend into at least a portion of lower holes 249 of the casing 218. The insert molding 250 of each contact assembly 220, 222 may also include one or more protrusions 290, 292 on the opposite side from the studs 282, 284, 286, 288 that when the contact assembly 220, 222 is inserted into the casing 218, extend into corresponding sockets or dimples in the adjacent side wall 226, 227 of the card slot 148. The studs 282, 284, 286, 288 and protrusions 290, 292 of the insert molding 250 may help to hold each of the contact assemblies 220, 220 generally in their proper locations in the casing 218. In use, the insert molding 250 can help to enable easier assembling of the contact elements into the contact assembly 220, 222 with the rest and consistent spacing of adjacent contact elements that helps improve high speed signal impedance control.

FIGS. 27–31 show the insertion of the FPCs 128, 129 into a card edge connector 106 and the positioning of a tension bar 294 with respect to a card edge connector 106 and the FPCs 128, 129. After the contact assemblies 220, 222 are inserted into the casing 218, the upper ends 150, 152 of the FPCs 128, 129 may be inserted into the card slot 148 from the open back 230 of the casing 218 so that the upper contacts 150, 152 of the FPCs 128, 129 are interposed between the back end regions 262 of the contacts of the upper and lower contact assemblies 220, 222.

Figure 32:
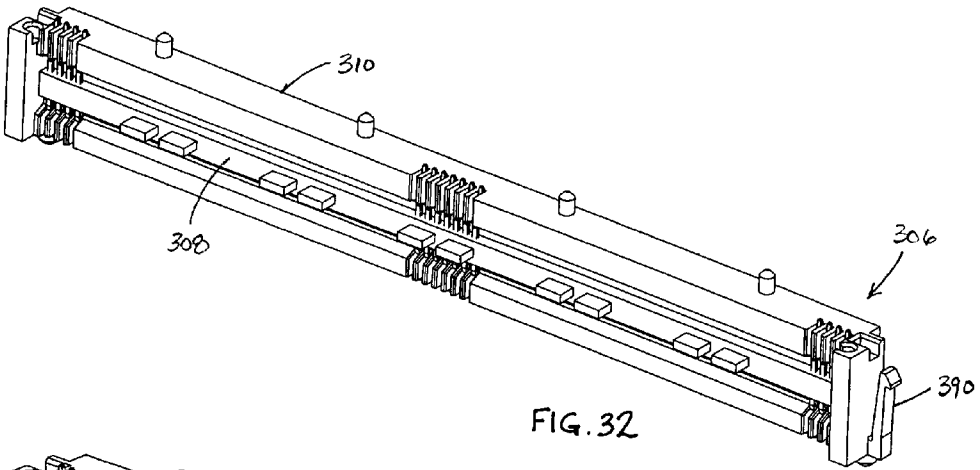
FIG. 32 is perspective view of a compression connector component in accordance with an exemplary AMC embodiment.
Figure 35:
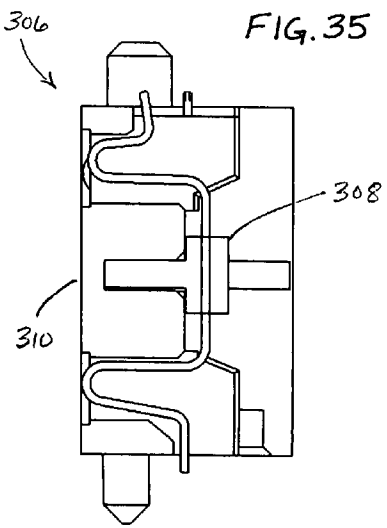
FIG. 35 is a schematic cross sectional view of the exemplary compression connector component shown in FIG. 32.
Figure 34:
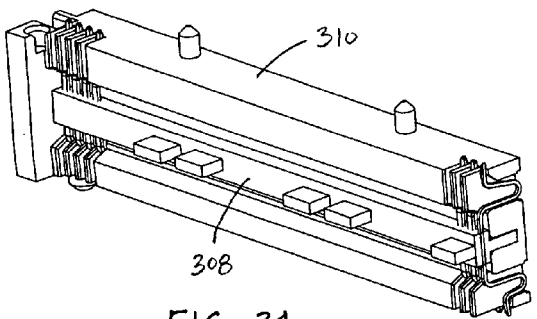
FIG. 34 is a schematic cross sectional perspective view of the exemplary compression connector component shown in FIG. 32.

With reference to FIGS. 31 and 32, the tension bar 294 (which also may be referred to as a key) may then be inserted into the card slot 148 from the open back 230 of the casing 218 so that the tension bar 294 is interposed (i.e., wedged) between the upper contacts 150, 152 of the two FPCs 128, 129. The tension bar 294 may be implemented so that it has a greater width (as defined between its top and bottom sides) than the clearance between the two FPCs 128, 129 so that the tension bar 294 forces the contacts of the card edge connector 106 (located outside of the FPCs) to touch to the contacts (or pads) 150, 152 on the FPCs 128, 129. As shown in FIG. 31, by wedging the tension bar 294 between the upper contacts 150, 152 of the two FPCs 128, 129, each of the upper contacts 150, 152 may be held in place against (i.e., abutting) the back end regions 262 of the contacts of the adjacent contact assembly 220, 222. Thus, the insertion of the tension bar 294 may help be used to keep the upper contacts 150, 152 of the FPCs 128, 129 in contact with the back end regions 262 of the contacts of the contact assemblies 220, 222.

As best shown in FIG. 30, the tension bar 294 may have a tapered front side 296 to assist in the wedging of the tension bar 294 between the upper contacts 150, 152 of the FPCs. Also, each end of the tension bar 294 may have a tab 298, 300 that extends into a corresponding notch 302, 304 in the casing 218 adjacent the open back 230 of the casing 218. The tabs 298,300 and notches 302, 304 may be included in an implementation to help facilitate the insertion of the tension bar 294 into the casing 218 as well as help to hold the tension bar 294 in place once inserted.

Figure 37:
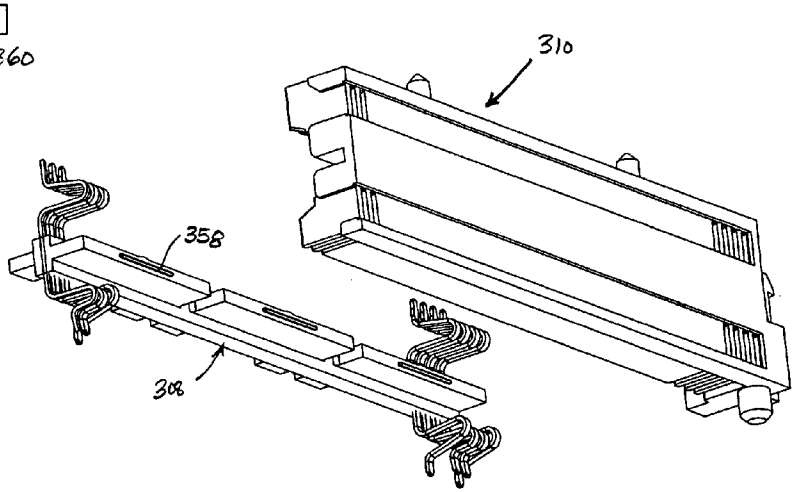
FIG. 37 is an exploded perspective view of the exemplary compression connector component shown in FIG. 36 as seen from an opposite direction.
Figure 38:
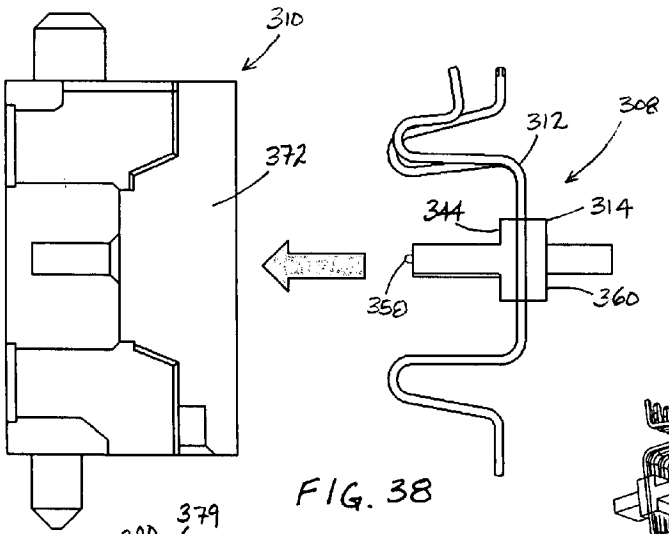
FIG. 38 is a schematic exploded cross sectional view of a compression connector component illustrating the insertion of a compression contacts assembly in accordance with an exemplary AMC embodiment.
Figure 36:
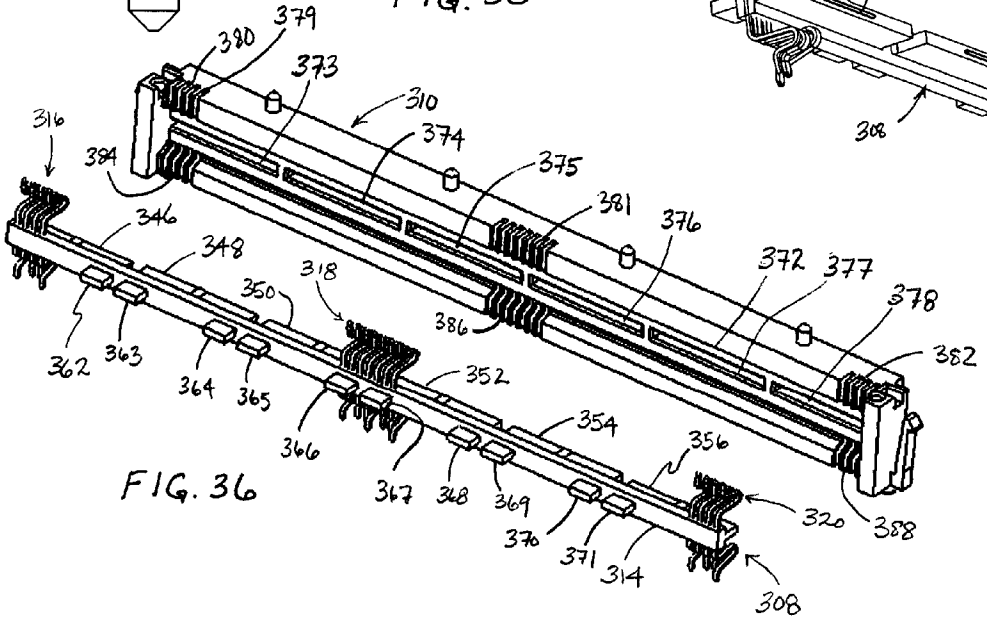
FIG. 36 is an exploded perspective view of a compression connector component in accordance with an exemplary AMC embodiment.

As previously described, a compression connector 138 may be formed from a pair of compression connector components 140, 142. FIGS. 32–42 show various elements of an exemplary compression connector component 306 that may be used, in pair, to form a compression connector 138 in accordance with an exemplary AMC embodiment. FIGS. 32–35 show the exemplary compression connector component 306 in an assembled form while FIGS. 36–38 provide exploded views of the exemplary compression connector component 306. The compression connector component 306 includes a compression contacts assembly 308 and a component body 310.

Figure 39:
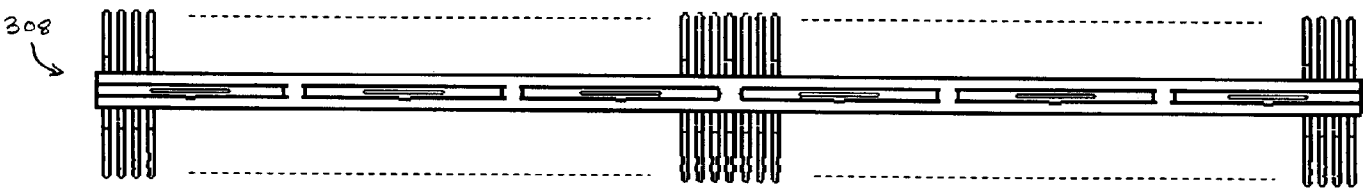
FIG. 39 is a schematic plan view of a compression contacts assembly of a compression connector component in accordance with an exemplary AMC embodiment.
Figure 41:
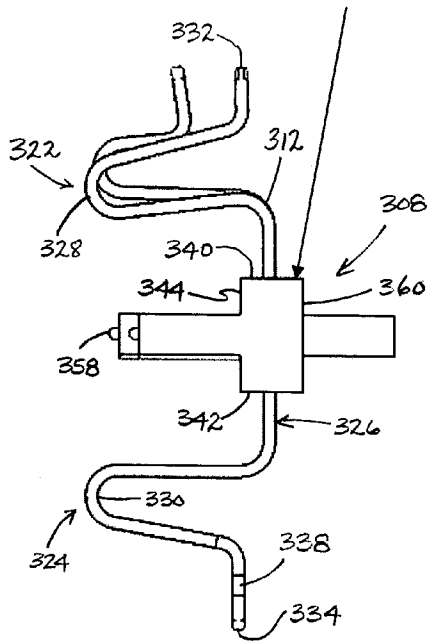
FIG. 41 is a schematic elevation view of the exemplary compression contacts assembly shown in FIG. 39 as seen from one end of the contacts assembly.
Figure 40:
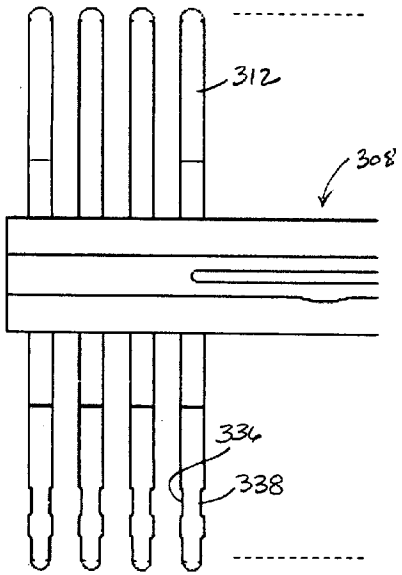
FIG. 40 is an enlarged view of an end region of the exemplary compression contacts assembly shown in FIG. 39.

FIGS. 39–41 show further details of the compression contacts assembly 308. The compression contact assembly 308 is similar to the contact assemblies 220, 222 of the card edge connector 106 in that it includes a plurality of contacts or contact elements (as represented by exemplary contact element 312) extending from an insert molding 314. The contact elements 312 are grouped into a plurality of groups of contact elements 316, 318, 320 with each group comprising one or more spaced apart contact elements 312. As depicted in the exemplary embodiment, a compression contact assembly 308 may be implemented having at least three groups of contact elements with a group located adjacent each end of the insert molding 314 (e.g., groups 316 and 320) and at least one another group 318 located in a middle region of the insert molding 314.

As represented by exemplary contact element 312, each contact element has a pair of opposite end regions 322, 324 (hereafter referred to as upper and lower end regions for convenience and clarity) connected together by a middle region 326. Each end region 322, 324 may include a hair-pin curve or bend 328, 330 located near a terminal end 332, 334 of the given end region. In one embodiment, the lower end region 324 of a contact element 312 may also include a pair lateral notches or grooves 336, 338 located between the lower hair-pin curve 330 and the lower terminal end 334 of the contact element 312. In one embodiment, each contact element 312 may be resiliently deflectable and may be constructed out of a conductive material (such as, e.g., some sort of metal).

The insert molding 314 of a compression contact assembly 308 is generally elongated and, as previously mentioned, has a plurality of contact elements 312 extending through it that may be arranged in a plurality of groups 316, 318, 320. As depicted in the exemplary embodiment, the middle region 326 of each contact element 312 may be extended through top and bottom longitudinal sides 340, 342 of the insert molding 314 so that the upper end region 322 of each contact element 312 outwardly extends from the top longitudinal side 340 and the lower end region 324 of each contact element 312 outwardly extends from the bottom longitudinal side 342. Each contact element 312 may also be orientated with the insert molding in such a manner that the hair pin curves 328, 330 of each contact element 312 generally extend outwardly in the same direction that a rear longitudinal side 344 of the insert molding 314 faces. In use, the insert molding 314 may help to enables easier insertion of the contact elements 312 into the component body 310 and help maintain consistent spacing of adjacent contact elements 312 to thereby help improve high speed signal impedance control.

The rear longitudinal side 344 of the insert molding 314 may have a plurality of extents outwardly extending therefrom with spaces between each adjacent pair of extents 346, 348, 350, 352, 354, 356. As best depicted in FIGS. 37, 38 and 41, each extent 346, 348, 350, 352, 354, 356 may have an outwardly projecting nub (e.g., nub 358). A forwards longitudinal side 360 of the insert molding 314 may also have a plurality of outwardly extending extents 362, 363, 364, 365, 366, 367, 368, 369, 370, 371. These extents 362, 363, 364, 365, 366, 367, 368, 369, 370, 371 may be grouped in spaced apart pairs and may be orientated in a manner so that each pair of extents (e.g., extents 362, 363) is in general alignment with a space formed between two extents (e.g., the space between extents 346 and 348) of the rear longitudinal side 344.

The component body 310 of a compression contacts assembly 306 has a receptacle 372 formed in one face (e.g., a front face) of the component body 310 that is adapted for receiving the compression contacts assembly 308. When assembled, the insert molding 314 of the compression contacts assembly 308 is inserted into the receptacle, rear longitudinal side 344 first, so that each of the rear extents 346, 348, 350, 352, 354, 356 of the insert molding 314 may be extended into a corresponding space 373, 374, 375, 376, 377, 378 formed in the back of the receptacle 372. The front face of the component body 310 may also have a plurality of contact slots (e.g., contact slot 379) into the receptacle 372 that can be arranged in groups 380, 381, 382, 384, 386, 388 (corresponding to the groups of contact elements 316, 318, 320 of the compression contact assembly 308) in order to receive the end regions 322, 324 of the contact elements 312 when the insert molding 314 is inserted into the receptacle 372 (see, e.g., FIGS. 32, and 34).

A component connector component 306 may be implemented so that it has a deflectable latch 390, 391 or locking mechanism at each end of the component body 310. When assembling the connector 100 in such an embodiment, the pair compression connector components 140, 142 may be inserted into the lower opening 173 of case 130 so that the latches 390, 391 of the compression connector components 140, 142 are slideably extended into corresponding end channels 394, 396, 398, 400 along the inside end walls of the case 130 so that the latches 390, 391 can engage regions of the case 130 inside the end channels 394, 396, 398, 400 to help hold the compression connect components 140, 142 in place (see e.g., FIGS. 6 and 13) in the case 130. J. Each of the latches 390, 391 may comprise an arm 292 with a hook 293 at its end. When the compression connector components 140, 142 are inserted into the case 130, the latches 390, 391 are slid into their associated end channels 394, 396, 398, 400 in the case 130 to help align each compression connector 140, 142 with the other components of the connector 100. Each of the end channels 394, 396, 398, 400 may have hook holes or detents or divots (e.g., holes 401, 402) that may engage the hooks 293 and thereby help align and hold the compression connector components 140, 142 in their locations in the case 130 (so that, e.g., the compression connection components 140, 142 do not slide or fall out of the case). As depicted in the exemplary connector 100, an embodiment may be implemented where the end channel holes 401, 402 extend all the way through the adjacent side wall of the case 130. In one embodiment, the end channels 394, 396, 398, 400 in the case 130 can be designed to provide sufficient clearance to permit movement of the compression connector components 140, 142 inside the case 130 in order to help permit the compression of the compression connection component 140, 142 inside the case 130 when coupling the compression connector 138 to a board 102.

Figure 42:
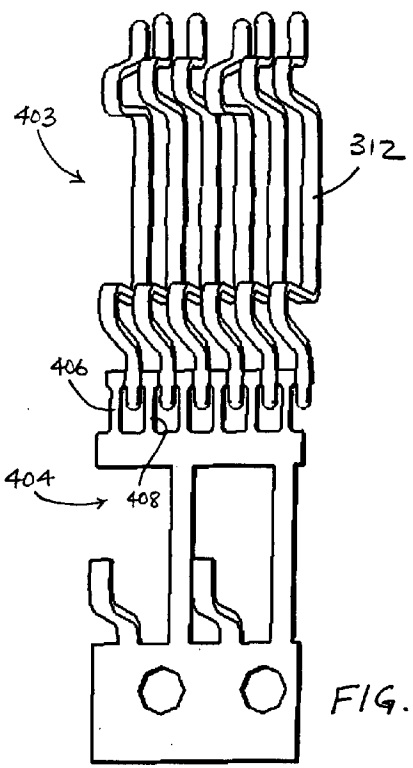
FIG. 42 is a schematic perspective view of a contacts element for a compression contacts assembly with an attached carrier portion in accordance with an exemplary AMC embodiment.

With reference to FIG. 42, each group of contact elements (e.g., group 318) may be formed in one exemplary implementation from a single form 403 that includes a carrier portion 404 coupled to one end (e.g., end 334) or end region (e.g., end region 324) of each contact element 312 in the group 318. In such an implementation, the carrier portion 404 may include a plurality of fingers (e.g., fingers 406, 408) with each end (e.g., end 334) or end region (e.g., end region 324) of the contact elements 312 in the group 318 coupled to adjacent pairs of fingers. Using such an form 403 permits each group of contact elements (e.g., group 318 as shown in FIG. 42) to be manufactured as a single element and helps to allow easier positioning and setting of the groups when the insert molding 314 is formed around it. Once the insert molding 314 has been formed around the middle regions 326 of the contact elements 312, the carrier portion 404 may be cut away to separate it from the end regions (e.g., end region 324) of the contact elements 312. As previously mentioned, contact elements for high speed applications may be designed to have very short or no stubs in order to reduce interference signals. By using the embodiment shown in FIG. 42 to form the contact elements of a compression connector component may advantageously permit the forming of the contact elements with short or no stubs on their bottom ends.

Figure 43:
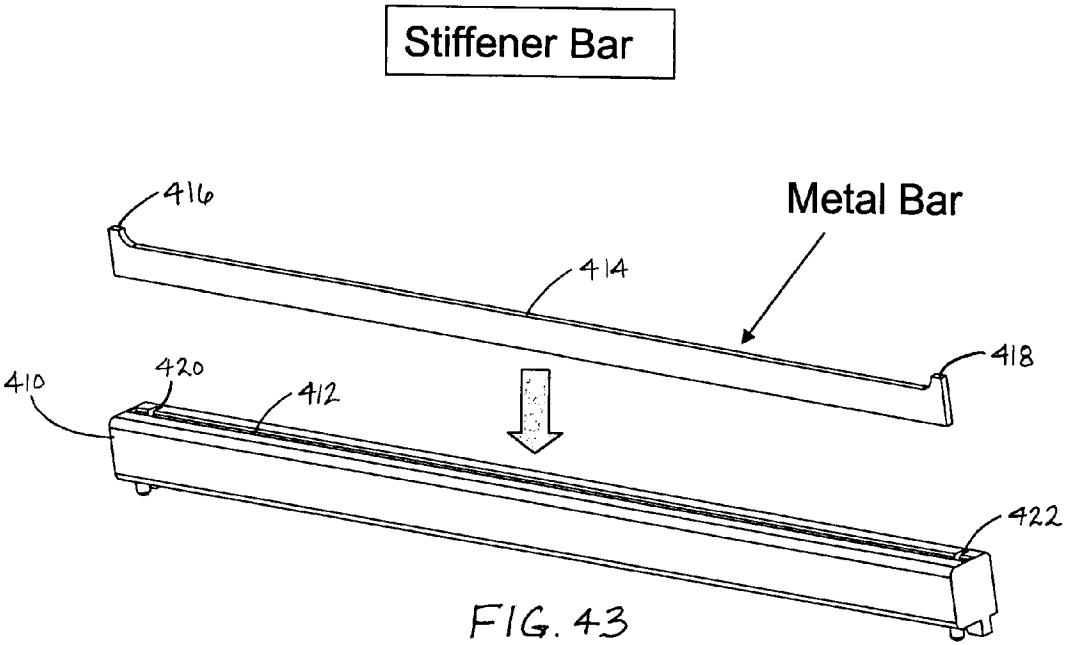
FIG. 43 is a schematic exploded perspective view of a stiffener bar in accordance with an exemplary AMC embodiment.
Figure 44:
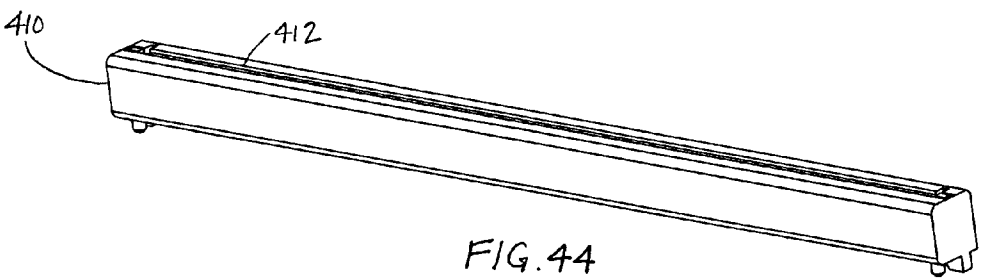
FIG. 44 is a schematic perspective view of a stiffener bar in accordance with an exemplary AMC embodiment.

Each of the stiffener bars 134, 136 of a connector 100 may each be implemented using the exemplary stiffener bar 410 shown in FIGS. 43 and 44. The stiffener bar 410 may have a longitudinal slot 412 in its upper face that extends between the ends of the stiffener bar 410. An elongated stiffening strip 414 may be inserted into the longitudinal slot 412 to provide additional rigidity to the stiffener bar 410 and help prevent unwanted bending or deflection of the stiffener bar 410. In one embodiment, the stiffening strip 414 may be manufactured from some sort of metal. In such an embodiment, the stiffener bar body 134, 136 may be constructed from some sort of non-conductive/insulating material (e.g., a non- or low-conducting plastic and/or polymeric material) to help provide sufficient clearance and insulation between the electrical lines of the FPCs 128, 129 and the metal stiffening strip 414.

In one embodiment, each end of the stiffening strip 414 may an outwardly extending lateral extent 416, 418 to help provide points of contact for holding the stiffening strip when inserting or removing its from the longitudinal slot. As shown in FIG. 43, each lateral extent 416, 418 may be implemented so that it has an substantially straight outer edge that is flush and parallel with the adjacent end of the stiffening strip 414 and an concave arcuate inner edge to help prevent catching of the lateral extents 416, 418 during insertion or removal of the stiffening strip 414 from the longitudinal slot 412.

The longitudinal slot 412 may also have a pair of side slots 420, 422 with one side slot located adjacent each end of the longitudinal slot 412. In one embodiment, the side slots 420, 422 may extend substantially perpendicularly to the longitudinal axis of the longitudinal slot 412. The side slots 420, 422 may be included in a stiffener bar 410 implementation to help assist with the insertion of the stiffening strip 414 into the longitudinal slot 412 and to help prevent cracking or splitting of the stiffener bar 410 after the stiffening strip 414 has been inserted into the longitudinal slot 412.

In use, the compression connector 138 (i.e., each compression connector component 140, 142) may be compressed to a carrier board 102 (and thereby coupled to the board) using the hold down screws 112, 114 and bottom stiffener plate 108 to hold the case 130 in a position where the compression connector 138 is compressed to the board 102. In this arrangement, the compression connector 138 may be supported inside the case 130 by the stiffener bars 134, 136. The stiffener bars 134, 136 and the bottom stiffener plate 108 sandwich the compression contacts (e.g., contact element 312), the board 102 and the FPCs 128, 129 together in order to help create a good connection between them.

In an AMC implementation, an embodiment of the connector 100 may serve as a "Z-pluggable" surface mounted compression connector. The design of the connector 100 is modular in concept with three basic parts: the contacts mating to the AMC Module 104 and the FPCs 128, 129, and the contacts mating to the carrier board 102 and the FPCs 128, 129. In an AMC implementation, many of the internal parts can be constructed so that they are interchangeable with B, B+, AB, and A+B+ connectors (as defined by the AMC specification) with only the general outer configuration of the case 130 being different (according to the different type of AMC connector). This can help a manufacture by providing more flexibility to meet a given product specification and/or design.

Embodiments of the connector may be used as part of a system to couple first and second circuit board. For example, in one embodiment, the first connector receiving a first circuit board while the case of the connector can be positioned adjacent a second circuit board so that the second connector and second end of the flexible circuit are pinched (and/or compressed and/or squeezed) between the stiffener bar and the second circuit board. A plate may also be provided that is positioned adjacent a face of the second circuit board opposite the connector. At least one fastener may be extended through the connector, second circuit board and the plate to couple the connector, second circuit board and plate together with the tightening of fastener to provide a force to urge the second circuit board and the case together and thereby pinch/compress the second connector and second end of the flexible circuit between the stiffener bar and the second circuit board.

In use, embodiments of the connector/connector unit may be utilized in a method where a first circuit board can be inserted into a first connector of the connector unit. In this method, a first face of a second circuit board may be positioned against the connector unit adjacent a second connector of the connector unit. A plate may be positioned adjacent a second face of the second circuit board opposite the first face of the second circuit board and at least one fastener may be extended through the connector unit, second circuit board and the plate to urge the second circuit board towards the connector unit so that the second connector is pinched between the second circuit board and a stiffener bar in the connection unit.

While reference in the present specification has been made to top, bottom, front and back, and so on, it should be understood, especially those of ordinary skill in the art, that these terms have been used merely to facilitate better comprehension of the embodiments described herein and are not intended to be limit the orientation of the embodiments described herein. For example, it should be readily understood that the orientation of the embodiments may be turned upside-down (or sideways or any other orientation) so that top and bottom are reverse without affecting the relationships between the elements described herein.

While various embodiments have been described, they have been presented by way of example only, and not limitation. Thus, the breadth and scope of any embodiment should not be limited by any of the above described exemplary embodiments, but should be defined only in accordance with the following claims and their equivalents.

What is claimed:

1. A connector unit, comprising:

a case having at least first and second openings therein;

at least first and second connectors, the first connector located in the first opening and the second connector located in the second opening;

at least one stiffener bar disposed in the case;

at least one flexible circuit having at least first and second ends;

the first connector receiving the first end of the flexible circuit; and the second end of the flexible circuit being interposed between the stiffener bar and the second connector.

2. The connector unit of claim 1, wherein the stiffener bar and the flexible circuit each have at least one hole therethrough, and the second connector has at least one prong extending through the hole of the flexible circuit and into the hole of the stiffener bar.

3. The connector unit of claim 1, wherein the second connector and the flexible circuit each have at least one hole therethrough, and the stiffener bar has at least one prong extending through the hole of the flexible circuit and into the hole of the second connector.

4. The connector unit of claim 1, wherein the first connector has an opening for receiving the first end of the flexible circuit, and further comprising a key is inserted into the opening to wedge the first end of the flexible circuit against at least one contact element of the first connector.

5. The connector unit of claim 1, wherein the stiffener bar includes a stiffener plate therein.

6. The connector unit of claim 5, wherein the stiffener plate comprises a metal and the stiffener bar comprises a material less conductive than the metal.

7. The connector unit of claim 5, wherein the stiffener plate is located a distance from a face of the stiffener bar which faces the flexible circuit.

8. The connector unit of claim 1, wherein at least one connector comprises a card slot connector adapted for receiving an edge of a circuit board therein.

9. The connector unit of claim 8, wherein the card slot connector is assembled to the case with floating condition.

10. The connector unit of claim 8, wherein the card slot connector has a plurality of contact elements formed from a form where each contact element has an end coupled to a carrier.

11. The connector unit of claim 1, wherein at least one connector comprises a compression connector adapted for being compressed between a circuit board and the stiffener bar.

12. The connector unit of claim 11, wherein the compression connector is assembled to the case with floating condition.

13. The connector unit of claim 11, wherein the compression connector has a plurality of contact elements formed from a form where each contact element has an end coupled to a carrier.

14. The connector unit of claim 1, wherein the case has at least one channel therein and the at least one connector has at least one latch extending into the channel.

15. The connector unit of claim 14, wherein the channel has an aperture therein and the latch has a hook extending into the aperture.

16. The connector unit of claim 1, wherein the at least one flexible circuit comprises at least first and second flexible circuits and a separator is interposed between the first and second flexible circuits.

17. The connector unit of claim 16, wherein the at least one stiffener bar comprises at least first and second stiffener bars, and wherein the first stiffener bar is interposed between the first and second flexible circuits and the second flexible circuit is interposed between the first and second stiffener bars.

18. The connector unit of claim 1, wherein at least one of the connectors has a contact assembly comprising a plurality of contact elements extending through a molding.

19. The connector unit of claim 18, wherein the molding has at least one extent extending into a receptacle in the at least one connector.

20. The connector unit of claim 18, wherein the plurality of contact elements are arranged into one or more groups along the molding.

21. The connector unit of claim 18, wherein at least one group of contact elements is formed from a form having a plurality of contact elements each having an end coupled to a carrier.

22. A system, comprising:

a connector unit having a case, at least first and second connectors, at least one stiffener bar, and at least one flexible circuit;

wherein the first connector is located in a first opening of the case and the second connector is located in a second opening of the case;

wherein the first connector receives a first end of the flexible circuit and a second end of the flexible circuit is interposed between the stiffener bar and the second connector;

a first circuit board, the first connector receiving the first circuit board; and a second circuit board, the case of the connector unit being positioned adjacent the second circuit board so that the second connector and second end of the flexible circuit are pinched between the stiffener bar and the second circuit board.

23. The system of claim 22, further comprising a plate located adjacent a face of the second circuit board opposite the connector unit, and at least one fastener extending through the connector unit, second circuit board and the plate.

24. A method of assembling a connector unit, comprising:

providing a case having at least first and second openings therein;

placing a first connector in the first opening of the case;

placing a second connector in the second opening of the case;

disposing at least one stiffener bar in the case;

providing at least one flexible circuit having at least first and second ends;

placing the first end of the flexible circuit in the first connector; and interposing the second end of the flexible circuit being between the stiffener bar and the second connector.

* * * * *